US010967232B2

(12) United States Patent
Woodward et al.

(10) Patent No.: US 10,967,232 B2
(45) Date of Patent: Apr. 6, 2021

(54) CLUB HEAD HAVING BALANCED IMPACT AND SWING PERFORMANCE CHARACTERISTICS

(71) Applicant: KARSTEN MANUFACTURING CORPORATION, Phoenix, AZ (US)

(72) Inventors: Alex G. Woodward, Phoenix, AZ (US); Christopher M. Broadie, Phoenix, AZ (US); Erik M. Henrikson, Phoenix, AZ (US); Paul D. Wood, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/875,632

(22) Filed: May 15, 2020

(65) Prior Publication Data

US 2020/0360772 A1 Nov. 19, 2020

Related U.S. Application Data

(60) Provisional application No. 62/878,692, filed on Jul. 25, 2019, provisional application No. 62/848,429, filed on May 15, 2019.

(51) Int. Cl.
*A63B 53/04* (2015.01)
*A63B 60/02* (2015.01)

(52) U.S. Cl.
CPC ..... *A63B 53/0466* (2013.01); *A63B 60/02* (2015.10); *A63B 53/0408* (2020.08); *A63B 53/0437* (2020.08); *A63B 53/0445* (2020.08); *A63B 2053/0491* (2013.01)

(58) Field of Classification Search
CPC ..... A63B 53/0466
USPC ..... 473/324–350
See application file for complete search history.

(56) References Cited

U.S. PATENT DOCUMENTS

| | | | | |
|---|---|---|---|---|
| 6,010,411 | A | 1/2000 | Reyes | |
| 6,254,494 | B1 | 7/2001 | Hasebe et al. | |
| 6,386,990 | B1 | 5/2002 | Reyes et al. | |
| 6,425,832 | B2 * | 7/2002 | Cackett | A63B 60/00 473/345 |
| 6,547,676 | B2 | 4/2003 | Cackett et al. | |
| 6,607,452 | B2 | 8/2003 | Helmstetter et al. | |

(Continued)

FOREIGN PATENT DOCUMENTS

| | | |
|---|---|---|
| EP | 2340875 | 7/2011 |
| JP | 2005278800 | 10/2005 |
| JP | 2008154999 | 2/2008 |
| JP | 2009061264 | 3/2009 |

OTHER PUBLICATIONS

US 8,277,335 B2, 10/2012, Beach et al. (withdrawn)

(Continued)

*Primary Examiner* — Alvin A Hunter

(57) ABSTRACT

Described herein are embodiments of golf club heads having a balance of the following parameters: a low and back club head center of gravity position, a high moment of inertia, a large Ixy product of inertia, and low aerodynamic drag. Methods of manufacturing the embodiments of golf club heads having a balance of club head center of gravity position, moment of inertia, product of inertia, and aerodynamic drag are also described herein.

20 Claims, 22 Drawing Sheets

(56) References Cited

U.S. PATENT DOCUMENTS 6,669,580 B1 * 12/2003 Cackett ..... B29C 70/865 473/345
6,739,982 B2 * 5/2004 Murphy ..... A63B 53/04 473/342
6,739,983 B2 * 5/2004 Helmstetter ..... B21J 5/00 473/342
6,789,304 B2 9/2004 Kouno
6,939,247 B1 9/2005 Schweigert et al.
6,964,617 B2 * 11/2005 Williams ..... A63B 60/00 473/245
6,991,558 B2 1/2006 Beach et al.
6,994,636 B2 * 2/2006 Hocknell ..... A63B 60/00 473/342
7,025,692 B2 * 4/2006 Erickson ..... A63B 60/02 473/335
7,059,973 B2 * 6/2006 Erickson ..... A63B 60/00 473/345
7,066,835 B2 * 6/2006 Evans ..... A63B 60/02 473/346
7,115,047 B2 * 10/2006 Stevens ..... A63B 53/02 473/334
7,118,493 B2 * 10/2006 Galloway ..... A63B 60/00 473/329
7,121,955 B2 * 10/2006 Stevens ..... A63B 60/00 473/334
7,121,957 B2 * 10/2006 Hocknell ..... A63B 53/02 473/342
7,128,661 B2 * 10/2006 Soracco ..... A63B 53/0466 473/329
7,137,905 B2 11/2006 Kohno
7,163,468 B2 * 1/2007 Gibbs ..... A63B 60/00 473/329
7,169,060 B2 * 1/2007 Stevens ..... A63B 60/00 473/329
7,226,366 B2 * 6/2007 Galloway ..... A63B 60/00 473/342
7,232,380 B2 6/2007 Nakahara
7,311,613 B2 * 12/2007 Stevens ..... A63B 53/02 473/329
7,410,428 B1 * 8/2008 Dawson ..... A63B 53/0466 473/345
7,438,647 B1 * 10/2008 Hocknell ..... A63B 53/06 473/334
7,438,649 B2 10/2008 Ezaki
7,452,287 B2 * 11/2008 Erickson ..... A63B 60/00 473/345
7,488,261 B2 * 2/2009 Cackett ..... A63B 53/0466 473/300
7,491,134 B2 * 2/2009 Murphy ..... A63B 60/00 473/329
7,500,926 B2 3/2009 Rae et al.
7,520,820 B2 * 4/2009 Dimarco ..... A63B 60/00 473/334
7,549,935 B2 * 6/2009 Foster ..... A63B 53/0466 473/335
7,559,851 B2 * 7/2009 Cackett ..... A63B 53/0466 473/300
7,563,178 B2 7/2009 Rae et al.
7,568,982 B2 * 8/2009 Cackett ..... A63B 53/0466 473/300
7,575,524 B2 8/2009 Willett et al.
7,591,737 B2 * 9/2009 Gibbs ..... A63B 53/02 473/329
7,651,410 B2 1/2010 Shimazaki
7,674,189 B2 3/2010 Beach et al.
7,713,143 B2 * 5/2010 Evans ..... A63B 53/0466 473/334
7,731,603 B2 6/2010 Beach et al.
7,753,809 B2 * 7/2010 Cackett ..... A63B 53/0466 473/345
7,850,544 B2 12/2010 Meyer et al.
8,025,591 B2 9/2011 De La Cruz et al.
8,083,609 B2 12/2011 Burnett et al.
8,100,781 B2 1/2012 Burnett et al.
8,172,697 B2 * 5/2012 Cackett ..... A63B 60/52 473/329
8,192,304 B2 6/2012 Rae et al.
8,206,244 B2 6/2012 Honea et al.
8,241,143 B2 8/2012 Albertsen et al.
8,267,808 B2 9/2012 De La Cruz et al.
8,333,668 B2 12/2012 De La Cruz et al.
8,435,137 B2 5/2013 Hirano
8,496,544 B2 7/2013 Curtis et al.
8,506,419 B2 8/2013 Hirano
8,550,934 B2 * 10/2013 Evans ..... A63B 60/00 473/324
8,647,216 B2 2/2014 Beach et al.
8,663,029 B2 3/2014 Beach et al.
8,758,153 B2 6/2014 Sargent et al.
8,808,108 B2 8/2014 Schweigert
8,834,294 B1 9/2014 Seluga et al.
8,858,359 B2 10/2014 Willett et al.
8,900,069 B2 12/2014 Beach et al.
8,951,143 B2 2/2015 Morales et al.
9,144,722 B2 * 9/2015 Schweigert ..... A63B 53/0466
9,168,429 B2 * 10/2015 Schweigert ..... A63B 53/04
9,186,561 B2 * 11/2015 Schweigert ..... A63B 53/0466
9,199,138 B2 12/2015 Willett et al.
9,220,953 B2 12/2015 Beach et al.
9,623,295 B2 4/2017 Willett et al.
9,675,851 B2 * 6/2017 Schweigert ..... A63B 53/08
9,717,962 B1 * 8/2017 Seluga ..... A63B 53/0466
9,764,205 B2 * 9/2017 Schweigert ..... A63B 53/04
9,764,206 B2 * 9/2017 Schweigert ..... A63B 53/04
9,839,818 B2 12/2017 Jertson et al.
9,925,430 B2 3/2018 Stokke et al.
9,925,432 B2 3/2018 Morales et al.
9,950,221 B2 4/2018 Albertsen et al.
9,950,224 B2 4/2018 Willett et al.
10,207,161 B2 * 2/2019 Stokke ..... A63B 53/0466
10,238,938 B2 * 3/2019 Schweigert ..... A63B 53/04
10,245,481 B1 4/2019 Cleghorn et al.
10,357,700 B2 * 7/2019 Schweigert ..... A63B 60/00
10,434,381 B2 * 10/2019 Stokke ..... A63B 53/04
10,486,037 B2 * 11/2019 Schweigert ..... A63B 53/0466
10,556,159 B2 * 2/2020 Stokke ..... A63B 53/0466
10,610,745 B2 * 4/2020 Stokke ..... A63B 60/02
10,668,341 B2 * 6/2020 Jertson ..... A63B 53/0466
2002/0006836 A1 1/2002 Helmstetter et al.
2003/0032500 A1 2/2003 Nakahara et al.
2008/0051215 A1 2/2008 Rae et al.
2009/0029795 A1 1/2009 Schweigert et al.
2009/0264218 A1 3/2009 Willett et al.
2009/0088269 A1 4/2009 Beach et al.
2009/0137338 A1 5/2009 Kajita
2010/0048316 A1 2/2010 Honea et al.
2010/0234125 A1 9/2010 Aoyama et al.
2010/0234126 A1 9/2010 Cackett et al.
2010/0285901 A1 11/2010 Schweigert
2010/0304888 A1 12/2010 Hirano
2010/0317460 A1 12/2010 Hirano
2010/0331096 A1 12/2010 Curtis et al.
2011/0312437 A1 12/2011 Sargent et al.
2012/0058839 A1 3/2012 De La Cruz et al.
2012/0071267 A1 3/2012 Burnett et al.
2012/0071268 A1 3/2012 Albertsen et al.
2012/0083361 A1 4/2012 Beach et al.
2012/0142452 A1 6/2012 Burnett et al.
2012/0149491 A1 6/2012 Beach
2012/0172146 A1 7/2012 Greaney et al.
2012/0202615 A1 8/2012 Beach et al.

OTHER PUBLICATIONS

International Search Report/Written Opinion, PCT Application No. PCT/US2014/028134, dated Jul. 1, 2014.
International Search Report/Written Opinion, PCT Application No. PCT/US2014/028099 dated Jul. 17, 2014.
International Search Report/Written Opinion, PCT Application No. PCT/US2014/028157, dated Jul. 17, 2014.

(56) References Cited

OTHER PUBLICATIONS

International Search Report/Written Opinion, PCT Application No. PCT/US2020/033216, dated Jul. 22, 2020.

* cited by examiner

CLUB HEAD HAVING BALANCED IMPACT AND SWING PERFORMANCE CHARACTERISTICS

CROSS-REFERENCE TO RELATED APPLICATIONS

This claims the benefit of U.S. Provisional Patent Appl. No. 62/848,429, filed on May 15, 2019, and U.S. Provisional Patent Appl. No. 62/878,692, filed on Jul. 25, 2019, the contents of all of which are incorporated fully herein by reference.

FIELD OF INVENTION

The present disclosure relates to golf club heads. In particular, the present disclosure is related to golf club heads having balanced impact and swing performance characteristics.

BACKGROUND

Various golf club head design parameters, such as volume, center of gravity position and product of inertia, affect impact performance characteristics (e.g. spin, launch angle, speed, forgiveness) and swing performance characteristics (e.g. aerodynamic drag, ability to square the club head at impact). Often, club head designs that improve impact performance characteristics can adversely affect swing performance characteristics (e.g. aerodynamic drag), or club head designs that improve swing performance characteristics can adversely affect impact performance characteristics. Accordingly, there is a need in the art for a club head having enhanced impact performance characteristics balanced with enhanced swing characteristics.

Figure 1:
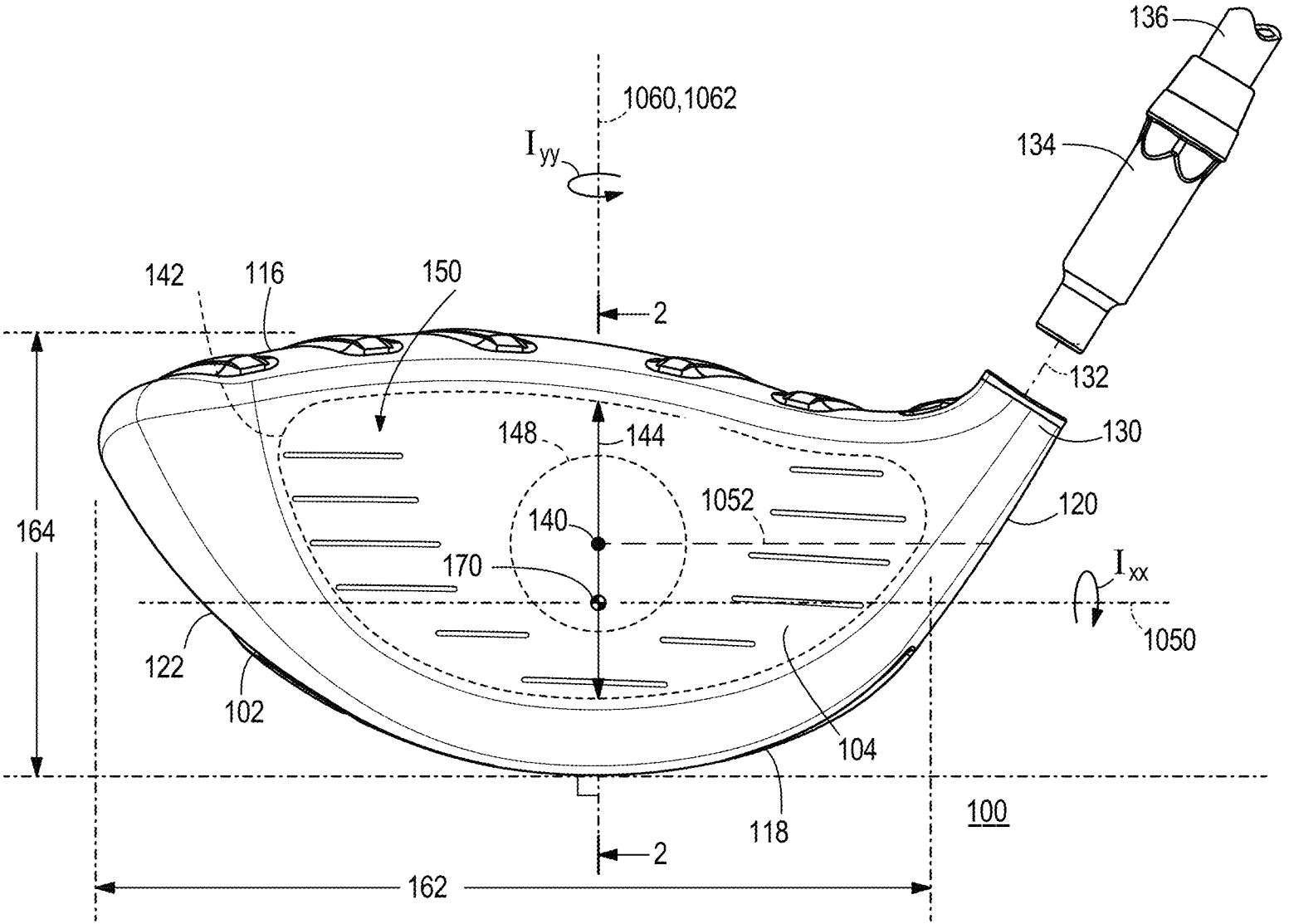
FIG. 1 is a front view of a golf club head.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The golf club head described below uses several relations that increase and maximize the club head product of inertia, while maintaining a down and back CG position, and a reduced aerodynamic drag. Specifically, the golf club described herein has a low and back CG as specified. The golf club further has a high crown-to-sole moment of inertia (Ixx) and heel-to-toe moment of inertia (Iyy). Furthermore, the golf club has a high magnitude (and positive) Ixy product of inertia term, paired with a small magnitude (and negative) Ixz product of inertia term, to effectively counter-act deleterious side spin caused by hitting golf shots above and below the center. Using removable weights or embedded weights (or weighted panel zones) allows for discretionary weight to be removed and placed on specific locations on (and within) the club head to balance the moments of inertia, products of inertia, center of gravity, and drag profile of the club head.

The golf club head described herein also has a reduced aerodynamic drag over golf club heads with a similar CG position and moment of inertia. Aerodynamic drag is reduced by maximizing the crown height while maintaining a low and back CG position. Transition profiles between the strikeface to crown, strikeface to sole, and/or crown to sole along the back end of the golf club head provide a means to reduce aerodynamic drag. The using of turbulators and strategic placement of hosel weight further reduce aerodynamic drag.

The golf club described below uses several relations that balances the club head moment of inertia, products of inertia, with a down and back CG position, while simultaneously maintaining or reducing aerodynamic drag. Balancing these relationships of CG, moment of inertia, products of inertia, and drag improve impact performance characteristics (e.g. side spin prevention on high and low face hits, launch angle, ball speed, and forgiveness) and swing performance characteristics (e.g. aerodynamic drag, ability to square the club head at impact, swing speed). This balance is applicable to a driver-type club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
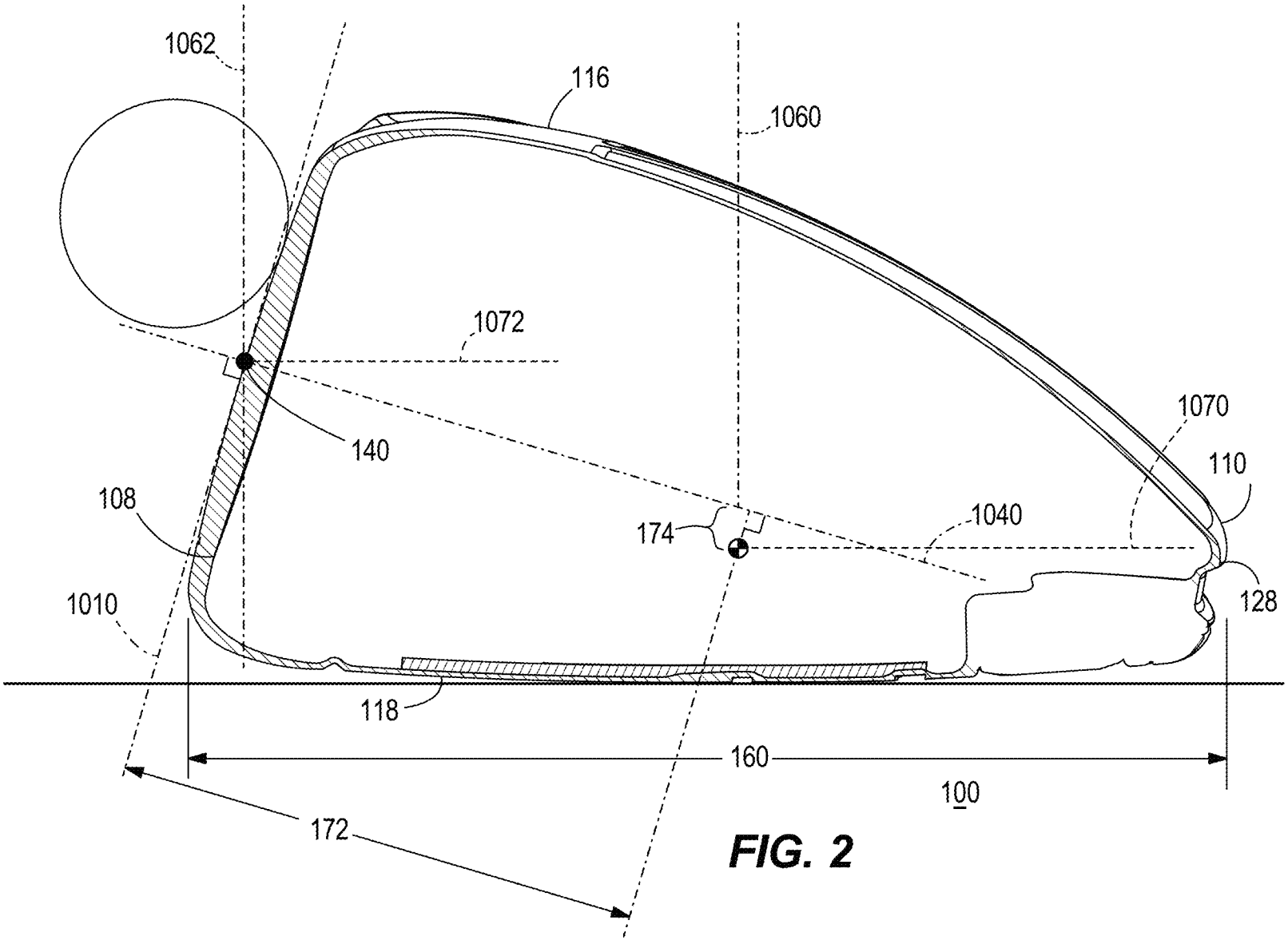
FIG. 2 is a side cross sectional view, along cross-sectional line 2-2, of the golf club head of FIG. 1

FIGS. 1-2 illustrate a golf club head 100 having a body 102 and a strikeface 104. The body 102 of the club head 100 includes a front end 108, a back end 110 opposite the front end 108, a crown 116, a sole 118 opposite the crown 116, a heel 120 and a toe 122 opposite the heel 120. The body 102 further includes a skirt or trailing edge 128 located between and adjoining the crown 116 and the sole 118, the skirt extending from near the heel 120 to near the toe 122 of the club head 100.

In many embodiments, the club head 100 is a hollow body club head. In these embodiments, the body 102 and strikeface 104 can define an internal cavity of the golf club head 100. In some embodiments, the body 102 can extend over the crown 116, the sole 118, the heel 120, the toe 122, the back end 110, and the perimeter of the front end 108 of the club head 100. In these embodiments, the body 102 defines an opening on the front end 108 of the club head 100 and the strikeface 104 is positioned within the opening to form the club head 100. In other embodiments, the strikeface 104 can extend over the entire front end 108 of the club head and can include a return portion extending over at least one of the crown 116, the sole 118, the heel 120, and the toe 122. In these embodiments, the return portion of the strikeface 104 is coupled to the body 102 to form the club head 100.

The strikeface 104 of the club head 100 comprises a first material. In many embodiments, the first material is a metal alloy, such as a titanium alloy, a steel alloy, an aluminum alloy, or any other metal or metal alloy. In other embodiments, the first material can comprise any other material, such as a composite, plastic, or any other suitable material or combination of materials.

The body 102 of the club head 100 comprises a second material. In many embodiments, the second material is a metal alloy, such as a titanium alloy, a steel alloy, an aluminum alloy, or any other metal or metal alloy. In other embodiments, the second material can comprise any other material, such as a composite, plastic, or any other suitable material or combination of materials.

As shown in FIG. 1, the club head 100 further comprises a hosel structure 130 and a hosel axis 132 extending centrally along a bore of the hosel structure 130. In the present example, a hosel coupling mechanism of the club head 100 comprises the hosel structure 130 and a hosel sleeve 134, where the hosel sleeve 134 can be coupled to an end of a golf shaft 136. The hosel sleeve 134 can couple with the hosel structure 130 in a plurality of configurations, thereby permitting the golf shaft 136 to be secured to the hosel structure 130 at a plurality of angles relative to the hosel axis 132. There can be other examples, however, where the shaft 136 can be non-adjustably secured to the hosel structure 130.

The strikeface 104 of the club head 100 defines a geometric center 140. In some embodiments, the geometric center 140 can be located at the geometric centerpoint of a strikeface perimeter 142, and at a midpoint of face height 144. In the same or other examples, the geometric center 140 also can be centered with respect to engineered impact zone 148, which can be defined by a region of grooves 150 on the strikeface. As another approach, the geometric center of the strikeface can be located in accordance with the definition of a golf governing body such as the United States Golf Association (USGA). For example, the geometric center of the strikeface can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The geometric center 140 of the strikeface 104 further defines a coordinate system having an origin located at the geometric center 140 of the strikeface 104, the coordinate system having an X' axis 1052, a Y' axis 1062, and a Z' axis 1072. The X' axis 1072 extends through the geometric center 140 of the strikeface 104 in a direction from the heel 120 to the toe 122 of the club head 100. The Y' axis 1062 extends through the geometric center 140 of the strikeface 104 in a direction from the crown 116 to the sole 118 of the club head 100 and perpendicular to the X' axis 1052, and the Z' axis 1072 extends through the geometric center 140 of the strikeface 104 in a direction from the front end 108 to the back end 110 of the club head 100 and perpendicular to the X' axis 1052 and the Y' axis 1062.

The coordinate system defines an X'Y' plane extending through the X' axis 1052 and the Y' axis 1062, an X'Z' plane extending through the X' axis 1052 and the Z' axis 1072, and a Y'Z' plane extending through the Y' axis 1062 and the Z' axis 1072, wherein the X'Y' plane, the X'Z' plane, and the Y'Z' plane are all perpendicular to one another and intersect at the origin of the coordinate system located at the geometric center 140 of the strikeface 104. The X'Y' plane extends parallel to the hosel axis 132 and is positioned at an angle corresponding to the loft angle of the club head 100 from the loft plane 1010. Further the X' axis 1052 is positioned at a 60 degree angle to the hosel axis 132 when viewed from a direction perpendicular to the X'Y' plane.

In these or other embodiments, the club head 100 can be viewed from a front view (FIG. 1) when the strikeface 104 is viewed from a direction perpendicular to the X'Y' plane. Further, in these or other embodiments, the club head 100 can be viewed from a side view or side cross-sectional view (FIG. 2) when the heel 120 is viewed from a direction perpendicular to the Y'Z' plane.

Figure 3:
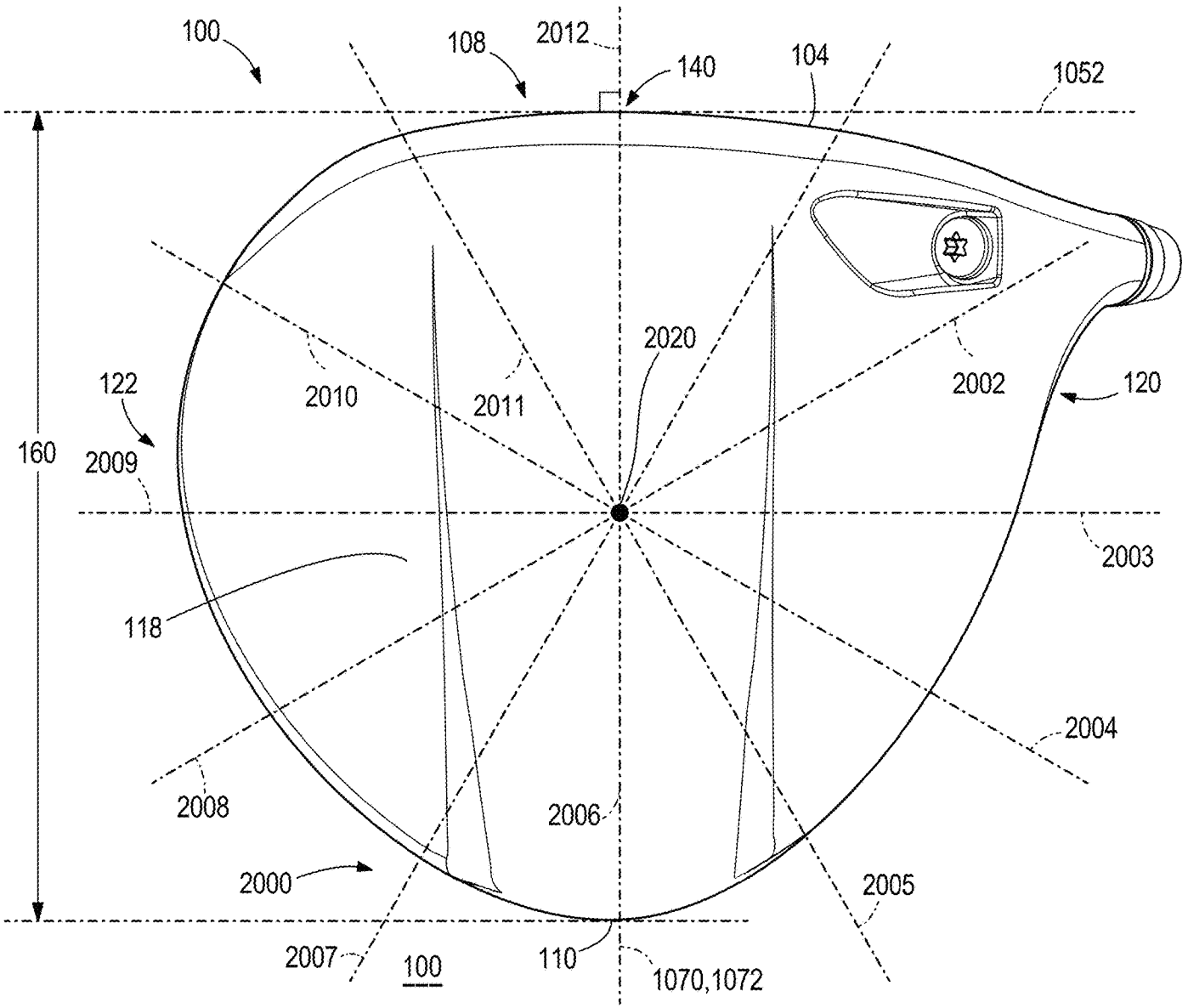
FIG. 3 is a bottom view of the golf club head in FIG. 1.

The club head 100 defines a depth 160, a length 162, and a height 164. Referring to FIG. 3, the depth 160 of the club head 100 can be measured as the furthest extent of the club head 100 from the front end 108 to the back end 110, in a direction parallel to the Z' axis 1072.

The length 162 of the club head 100 can be measured as the furthest extent of the club head 100 from the heel 120 to the toe 122, in a direction parallel to the X' axis 1052, when viewed from the front view (FIG. 1). In many embodiments, the length 162 of the club head 100 can be measured according to a golf governing body such as the United States Golf Association (USGA). For example, the length 162 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

The height 164 of the club head 100 can be measured as the furthest extend of the club head 100 from the crown 116 to the sole 118, in a direction parallel to the Y' axis 1062, when viewed from the front view (FIG. 1). In many embodiments, the height 164 of the club head 100 can be measured according to a golf governing body such as the United States Golf Association (USGA). For example, the height 164 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

As shown in FIGS. 1 and 2, the club head 100 further comprises a head center of gravity (CG) 170 and a head depth plane 1040 extending through the geometric center 140 of the strikeface 104, perpendicular to the loft plane 1010, in a direction from the heel 120 to the toe 122 of the club head 100. some embodiments, the head CG 170 can be located at a head CG depth 172 from the loft plane 1010, measured in a direction perpendicular to the loft plane. The head CG 170 is further located at a head CG height 174 from the head depth plane 1040, measured in a direction perpendicular to the head depth plane 1040. In many embodiments, the head CG 170 is located at a head CG depth 172 from strikeface 104 geometric center 140, measured in a direction parallel to the head depth plane 1040, from the loft plane 1010 to the CG 170. In many embodiments, the head CG 170 is strategically positioned toward the sole 118 and back end 110 of the club head 100 based on various club head parameters, such as volume and loft angle, as described below. In some embodiments, the head CG 170 is strategically positioned toward the sole 118 and back end 110 of the club head 100 based on various club head parameters, such as volume and loft angle, as described below.

The head CG 170 defines an origin of a coordinate system having an x-axis 1050, a y-axis 1060, and a z-axis 1070. The y-axis 1060 extends through the head CG 170 from the crown 116 to the sole 118, parallel to the hosel axis 132 when viewed from the side view and at a 30 degree angle from the hosel axis 132 when viewed from the front view. The x-axis 1050 extends through the head CG 170 from the heel 120 to the toe 122 and perpendicular to the y-axis 1060 when viewed from a front view and parallel to the X'Y' plane. The z-axis 1070 extends through the head CG 170 from the front end 108 to the back end 110 and perpendicular to the x-axis 1050 and the y-axis 1060. In many embodiments, the x-axis 1050 extends through the head CG 170 from the heel 120 to the toe 122 and parallel to the X' axis 1052, the y-axis 1060 through the head CG 170 from the crown 116 to the sole 118 parallel to the Y' axis 1062, and the z-axis 1070 extends through the head CG 170 from the front end 108 to the back end 110 and parallel to the Z' axis 1072.

I. Driver-Type Club Head

According to one example, a golf club head 100 comprises a high volume and a low loft angle. In many embodiments, the golf club head 100 comprises a driver-type club head. In other embodiments, the golf club head 100 can comprise any type of golf club head having a loft angle and volume as described herein.

In many embodiments, the loft angle of the club head 100 is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the club head 100 is greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 445 cc-485 cc, 425 cc-500 cc, approximately 500 cc-600 cc, approximately 500 cc-650 cc, approximately 550 cc-600 cc, approximately 600 cc-650 cc, approximately 650 cc-700 cc, 700 cc-750 cc, or approximately 750 cc-800 cc.

In many embodiments, the length 162 of the club head 100 is greater than 4.85 inches. In other embodiments, the length 162 of the club head 100 is greater than 4.5 inches, greater than 4.6 inches, greater than 4.7 inches, greater than 4.8, greater than 4.9 inches, or greater than 5.0 inches. For example, in some embodiments, the length 162 of the club head 100 can be between 4.6-5.0 inches, between 4.7-5.0 inches, between 4.8-5.0 inches, between 4.85-5.0 inches, or between 4.9-5.0 inches.

In many embodiments, the depth 160 of the club head 100 is at least 0.70 inches less than the length 162 of the club head 100. In many embodiments, the depth 160 of the club head 100 is greater than 4.75 inches. In other embodiments, the depth 160 of the club head 100 is greater than 4.5 inches, greater than 4.6 inches, greater than 4.7 inches, greater than 4.8, greater than 4.9 inches, or greater than 5.0 inches. For example, in some embodiments, the depth 160 of the club head 100 can be between 4.6-5.0 inches, between 4.7-5.0 inches, between 4.75-5.0 inches, between 4.8-5.0 inches, or between 4.9-5.0 inches.

In many embodiments, the height 164 of the club head 100 is less than approximately 2.8 inches. In other embodiments, the height 164 of the club head 100 is less than 3.0 inches, less than 2.9 inches, less than 2.8 inches, less than 2.7, or less than 2.6 inches. For example, in some embodiments, the height 164 of the club head 100 can be between 2.0-2.8 inches, between 2.2-2.8 inches, between 2.5-2.8 inches, or between 2.5-3.0 inches. Further, in many embodiments, the face height 144 of the club head 100 can be approximately 1.3 inches (33 mm) to approximately 2.8 inches (71 mm). Further still, in many embodiments, the club head 100 can comprise a mass between 185 grams and 225 grams.

II. Product of Inertia

The golf club head 100 comprises an inertia tensor. The inertia tensor for the golf club head 100 is represented by equation (1) below. The inertia tensor principle axis (Ixx, Iyy, Izz) is maximized. The greater the golf club head 100 moment of inertia, the less likely the club head 100 experiences rotation when a torque is applied (i.e., not striking the golf ball in the geometric center of the strike face). It is often assumed that if the MOI of the club head 100 is maximized, and the golf ball is struck near the center 140, the golf ball will fly straight. However, the golf club head still experiences three main rotational effects due to the dynamics of an individual's golf swing.

$$I = \begin{bmatrix} I_{xx} & I_{xy} & I_{xz} \\ I_{xy} & I_{yy} & I_{yz} \\ I_{xz} & I_{yz} & I_{zz} \end{bmatrix} \tag{1}$$

Figure 8C:
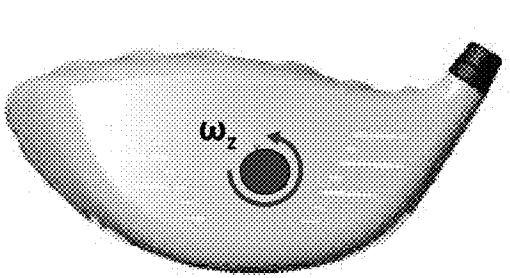
FIG. 8C is a front view of the golf club head of FIG. 1.
Figure 8B:
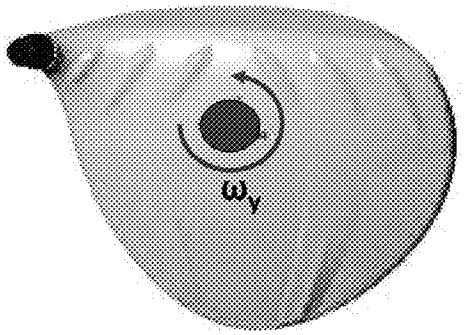
FIG. 8B is a top view of the golf club head of FIG. 1.
Figure 8A:
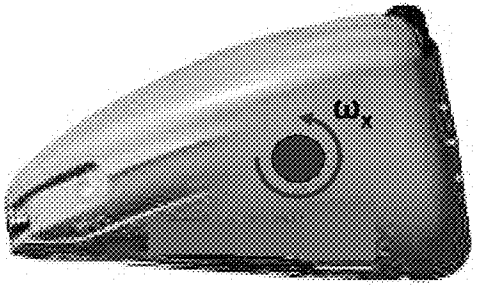
FIG. 8A is a toe side view of the golf club head of FIG. 1.

Referring to FIG. 8, there are three main rotational effects that the golf club head 100 experiences through impact, that are user generated (caused by the golfer swinging the golf club). In reference to FIG. 8A, the first effect, the lofting rate, is the time rate of change of the loft angle of the golf club head 100. The lofting rate is the rotational velocity about the x-axis 1050 of the golf club head 100. In reference to FIG. 8B, the closure rate, is the time rate of change of a face angle of the golf club head 100. The closure rate is the rotational velocity about the y-axis 1060 of the golf club head 100. Finally, in reference to FIG. 8C, the third effect, the drooping rate, is the time rate of change of a lie angle of the golf club head 100 at impact. The drooping rate is the rotational velocity about the z-axis 1070 of the golf club head 100.

Figure 9:
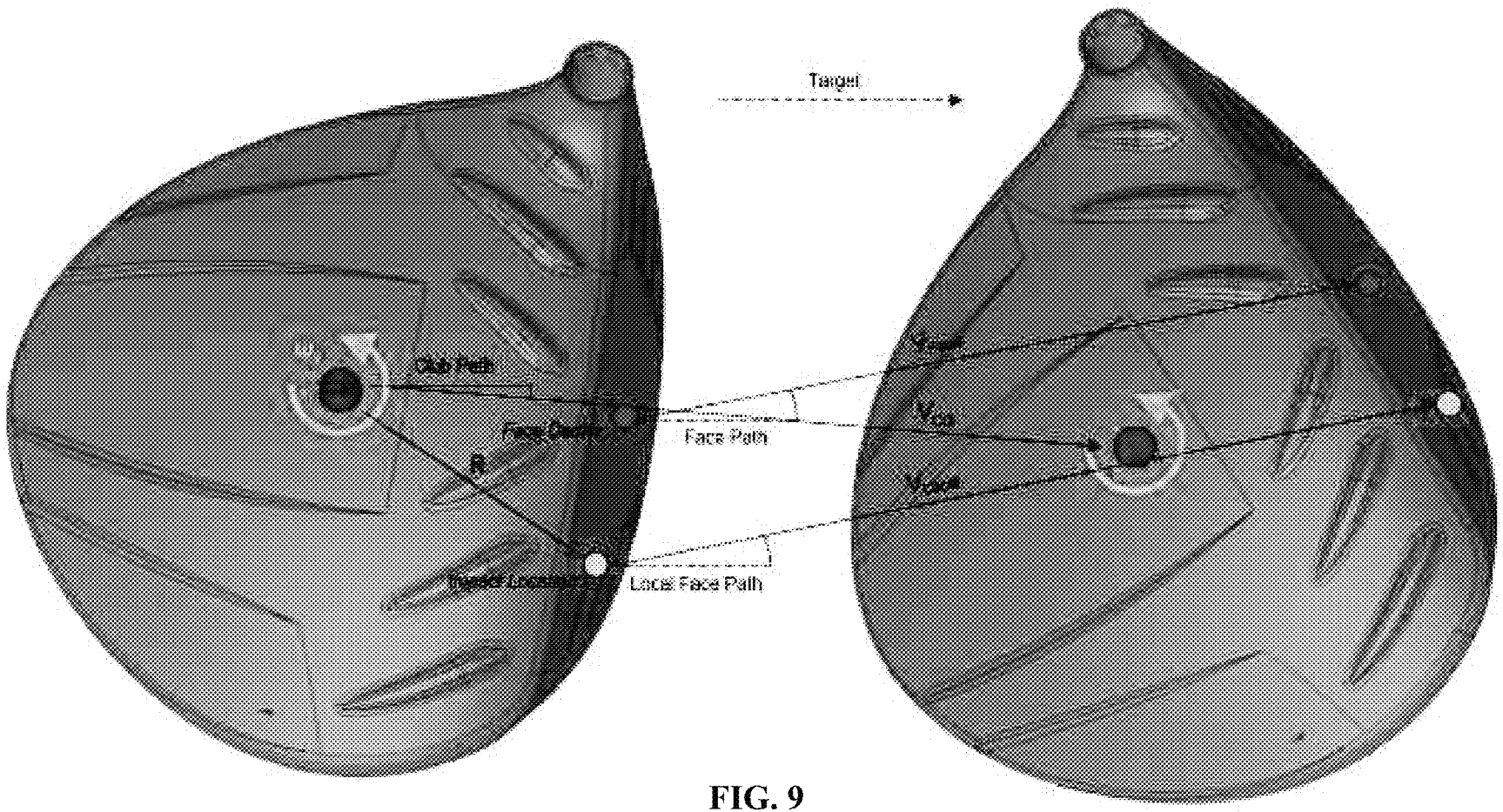
FIG. 9 is a top view of the golf club head rotation through impact of FIG. 1.

Further, in addition to the three main user generated rotational effects, a path the golf club 100 is swung on and a face angle of the golf club head 100 at impact are also user generated dynamics of an individual's swing. In reference, to FIG. 9, as aforementioned, the golf club rotates 100 about the CG in all three coordinate axes, throughout impact, due to lofting, closure, and drooping. The face angle of the golf club 100 at impact is the angle formed between a target line (a line formed from the golf ball to the desired end point of the golf ball) and a face line (a direction vector extending perpendicularly from the geometric center of the strike face, when projected onto the ground plane). The golf club path is the angle formed between the target line and a velocity vector of the golf club head, at the point of impact with the golf ball. The difference in between face angle and club path generates unwanted sidespin. The greater the difference in face angle and club path, the greater the sidespin generated.

Furthermore, when the golfer strikes the golf ball above or below the center of the golf club head, the club path changes, which can generate sidespin. For example, a golfer who strikes the ball in the center of the strike face, with a relatively small discrepancy between the face angle and club path (i.e., less than one degree) the golf ball usually travels on the target line to the desired end point of the golf ball. However, when the same golfer strikes the ball off the club face center (in a heel to toe direction), such as striking the ball just below center or just above center of the strike face (in a crown to sole direction), than the discrepancy may grow to 2 degrees or 3 degrees, and/or unwanted side spin is generated upon impact.

Referring again to FIG. 2, since the strike face of the golf club head is positioned at a loft angle, striking the golf ball above the center of the strike face creates an impact location nearer to the CG in the Z direction. In direct contrast, when the golf ball is struck below the center of the strike face, the impact location is further from the CG in the Z direction. The further the impact location is from the CG (and thus further from the axis of rotation), the quicker the shots will travel in the direction of the closing moment, because the closure rate is positive in magnitude, relative to the CG at impact. For example, again, assuming relatively straight delivery parameters (an approximately 1 degree discrepancy between the face angle and club path), golf shots struck above center will tend to draw, while golf shots struck below center will tend to fade.

When a golfer strikes the ball in the middle of the club face (in a heel to toe direction), but strikes the ball just below center or just above center of the strike face (in a crown to sole direction), the club head experiences a lofting moment ($\tau_x$), a closing moment ($\tau_y$), and a drooping moment ($\tau_z$). The angular accelerations experienced by the club head when struck just above or below the center can be represented by equations (2), (3), and (4) below. Assuming the golf ball is being struck above or below the x-axis 1050, but on (contacting) the y-axis 1060 and z-axis 1070, the torques applied about the y-axis 1060 and z-axis 1070 ($\tau_y \approx 0$, $\tau_z \approx 0$) are approximately zero. The torque applied on about the x-axis 1050 ($\tau_x$) is directly proportional to how far above or below center the golf ball is struck (i.e., the farther above center the ball is struck the greater the torque about the x-axis).

$$\alpha_x \approx \frac{\tau_x}{I_{xx}} \tag{2}$$

$$\alpha_y \approx -\frac{I_{xy}\tau_x}{I_{xx}I_{yy}} \tag{3}$$

$$\alpha_z \approx -\frac{I_{xz}\tau_x}{I_{xx}I_{zz}} \tag{4}$$

In order to minimize angular acceleration of the golf club head 100 at impact, the moment of inertia about the x-axis 1050, y-axis 1060, and z-axis 1070 can be increased, subsequently increasing the forgiveness of the golf club head 100, since the golf club head 100 better resists rotational torques about the principle axes (x-axis, y-axis, z-axis). If the golf club head 100 better resists rotational torques about the principle axes, the club head 100 is more forgiving for off-center impacts. However, even when MOI is maximized and a golf ball is struck above or below center (with desirable delivery parameters), the golf ball will still have unwanted sidespin. CG positioning and products of inertia, in addition to the moment of inertia, can be optimized and/or balanced to improve the impact characteristics of the golf club head 100, to minimize unwanted sidespin for high and low face hits, while maintaining forgiveness in a heel 120 to toe 122 direction.

In general, the product of inertia about two axes relate the symmetry of the club head 100 about a first axis, to the symmetry of the club head 100 about a second axis. Thus, the closer the product of inertia about two axes is near zero in magnitude, the less likely the golf club head 100 is to rotate about those respective axes simultaneously, since the club head 100 is symmetrically balanced.

It can be seen by equations (2), (3), and (4) that as the moments of inertia increase, the magnitude angular accelerations experienced by the golf club head decreases when striking the golf ball above or below center. However, even still, if the products of inertia (Ixy and Ixz) are made zero, causing $\alpha_y$ and $\alpha_z$ to go to zero, there is still an angular acceleration of the golf club head about the x-axis 1050, and unwanted sidespin created from the delivery parameters of the golf club head 100, for high and low face hits.

Referring to FIGS. 10-13, and equations (2)-(4), for wood-type golf club heads (with negative Ixy and Ixz products of inertia), when a golfer strikes the ball in the middle of the club face (in a heel to toe direction), but strikes the ball just below center or just above center of the strike face (in a crown to sole direction), the club head 100 undergoes a lofting moment, leading to rotational acceleration about all three axes.

In many embodiments, the club head 100 comprises an Ixy product of inertia is greater than approximately 30 g·cm$^2$, greater than approximately 40 g·cm$^2$, greater than approximately 50 g·cm$^2$, greater than approximately 60 g·cm$^2$, greater than approximately 70 g·cm$^2$, greater than approximately 80 g·cm$^2$, greater than approximately 90 g·cm$^2$, greater than approximately 100 g·cm$^2$, greater than approximately 110 g·cm$^2$, greater than approximately 120 g·cm$^2$, greater than approximately 130 g·cm$^2$, greater than approximately 140 g·cm$^2$, greater than approximately 150 g·cm$^2$, greater than approximately 160 g·cm$^2$, greater than approximately 170 g·cm$^2$, greater than approximately 180 g·cm$^2$, greater than approximately 190 g·cm$^2$, or greater than approximately 200 g·cm$^2$.

In many embodiments, the club head 100 comprises an Ixz product of inertia is greater than approximately −200 g·cm$^2$, greater than approximately −190 g·cm$^2$, greater than approximately −180 g·cm$^2$, greater than approximately −170 g·cm$^2$, greater than approximately −160 g·cm$^2$, greater than approximately −150 g·cm$^2$, greater than approximately −140 g·cm$^2$, greater than approximately −130 g·cm$^2$, greater than approximately −120 g·cm$^2$, greater than approximately −110 g·cm$^2$, greater than approximately −100 g·cm$^2$, greater than approximately −90 g·cm$^2$, greater than approximately −80 g·cm$^2$, greater than approximately −70 g·cm$^2$, greater than approximately −60 g·cm$^2$, greater than approximately −50 g·cm$^2$, greater than approximately −40 g·cm$^2$, or greater than approximately −30 g·cm$^2$.

Figure 10:
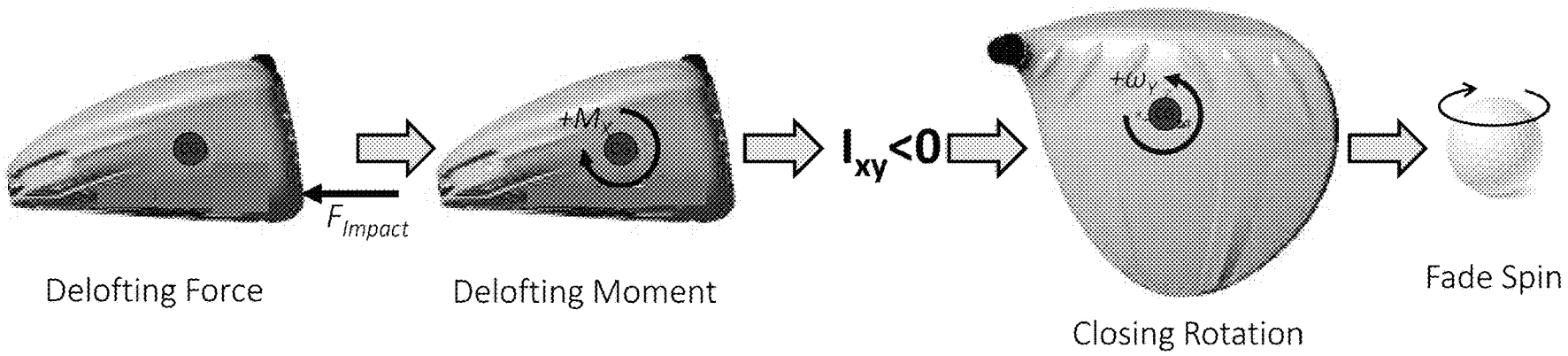
FIG. 10 is an illustration of the effect of a product of inertia Ixy on a delofting force from a below-center strike of a golf ball with the golf club head of FIG. 1.
Figure 11:
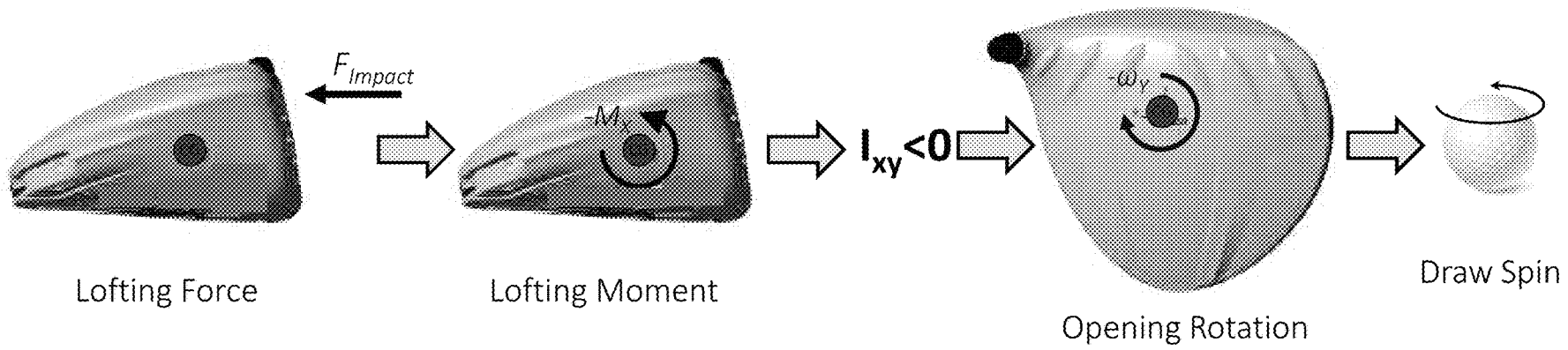
FIG. 11 is an illustration of the effect of the product of inertia Ixy on a lofting force from an above-center strike of a golf ball with the golf club head of FIG. 1.
Figure 12:
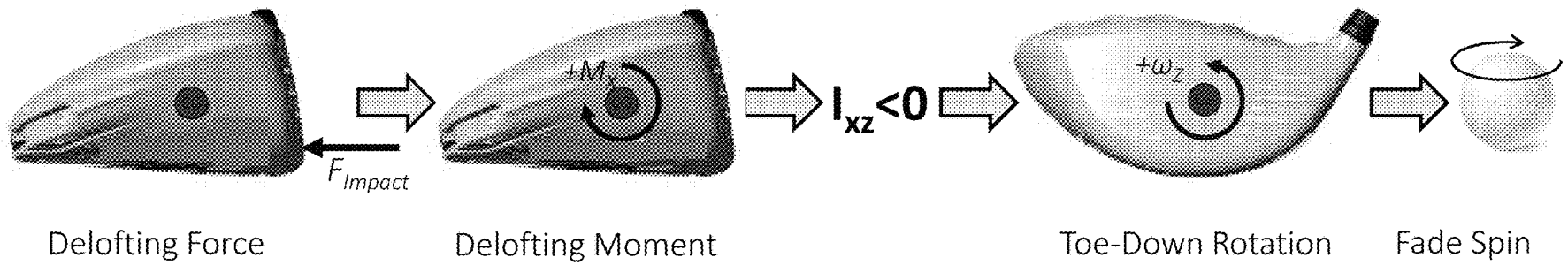
FIG. 12 is an illustration of the effect of the product of inertia Ixz on a delofting force from a below-center strike of a golf ball with the golf club head of FIG. 1.
Figure 13:
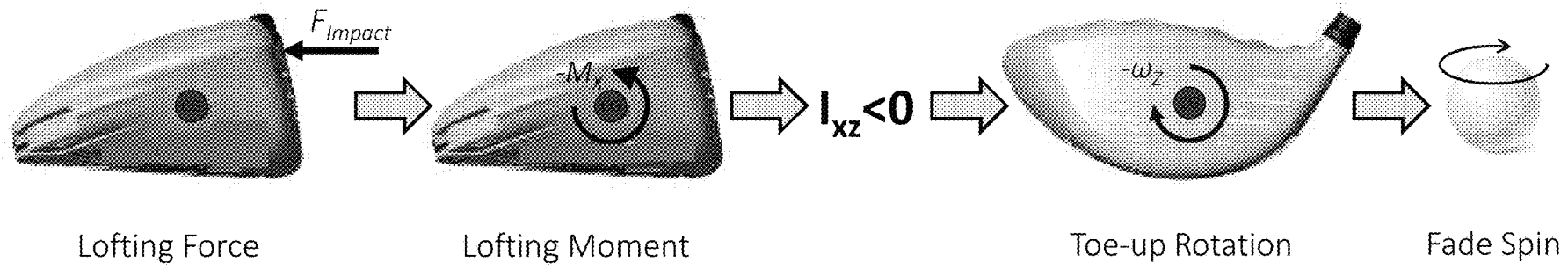
FIG. 13 is an illustration of the effect of the product of inertia Ixz on a lofting force from an above-center strike of a golf ball with the golf club head of FIG. 1.

Referring to FIGS. 10 and 12, when the golf club head 100 is struck below the center of the strike face, and Ixy is negative, the club head experiences a de-lofting moment in the golf club head, which creates a closing rotation, caused by Ixz, thereby leading to a fade spin imparted on the golf ball. Referring to FIGS. 11 and 13, when the golf club head is struck above the center of the strike face, and Ixy is negative, the club head experiences a lofting moment, which creates an opening rotation and toe up rotation of the golf club head, thereby leading to a draw spin imparted on the golf ball. The magnitude of this sidespin is proportional to $\alpha_y$ (and thus Ixy and $\tau_x$). If Ixy is made positive the behavior of the sidespin produced on high and low face hits becomes opposite (i.e., high face hits slice, while low face hits hook).

Changing the magnitudes of the products of inertia, can drastically affect the head rotational accelerations (Equations (2)-(4)) of the golf club head at impact, when the golf ball is struck above or below the center of the club face. The products of inertia can be optimized to eliminate the deleterious sidespin created the closure rate for low and high hits on the strike face. These products of inertia can be optimized, in addition to the moment of inertia, and CG positioning, in order to provide a golf club head with a down and back CG, high moment of inertia (forgiveness in a heel to toe direction), and forgiveness above and below the center of the strikeface. In addition, the club's 100 aerodynamic can further be balanced with CG and moment of inertia for an ultimately balanced performance of the golf club.

Figure 14B:
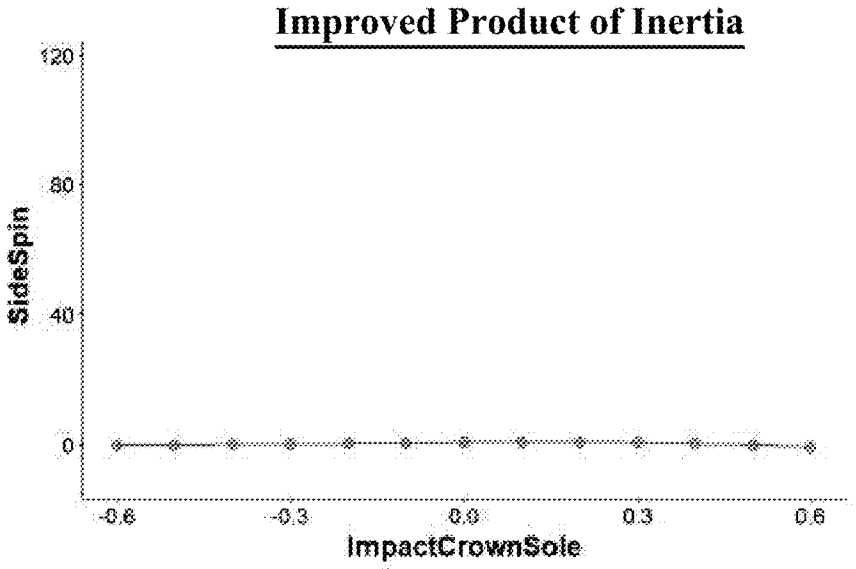
FIG. 14B illustrates a relationship between the sidespin imparted on a golf ball and the impact location above or below the geometric center of the golf club head of FIG. 1.
Figure 14A:
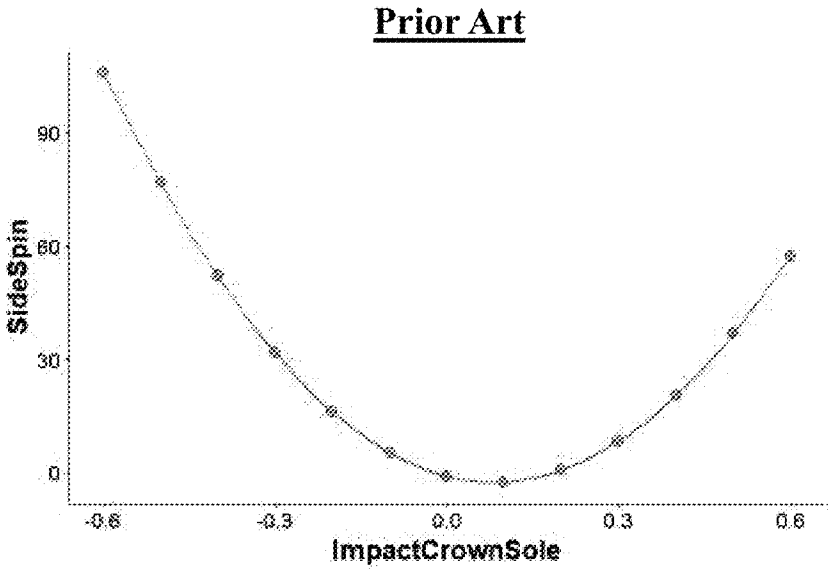
FIG. 14A illustrates a relationship between the sidespin imparted on a golf ball and the impact location above or below the geometric center of a general prior art golf club head.

As aforementioned, it is possible to achieve no angular acceleration about the y-axis 1060 and z-axis 1070 ($\alpha_y$ and $\alpha_z$=0), by making the products of inertia, Ixy and Ixz, equal to zero. However, as previously stated, there is still sidespin generated by the discrepancy in the face angle and the club path. Referring to FIG. 14A, the side spin generated by a driver-type golf club head when struck above and below center (with desirable delivery parameters) is shown. The further above or below center the ball is struck, the more sidespin is generated. This sidespin can lead to shots that do not go the length or direction desired.

In order to counteract this unwanted sidespin generated, the Ixy product of inertia can be maximized (greater than zero) to create favorable angular acceleration about the y axis ($\alpha_y$). A maximized Ixy product of inertia can be used to negate the sidespin generated by the difference in the face angle and club path for high and low face hits. In reference to FIG. 14B, it can be seen that a theoretical golf club head with an improved product of inertia can negate the sidespin created by hits above and below center, leading to a golf shot with a consistent distance and direction (devoid of sidespin).

III. Center of Gravity Position and Moment of Inertia

The golf club head 100 comprises a low and back CG, balanced with a high moment of inertia (Ixx, Iyy, Izz), while maximizing the Ixy product of inertia, and nearly zeroing the Ixz product of inertia. In many embodiments, a low and back club head CG and increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. Repositioning discretionary weight to maximize the distance from the head CG can be achieved using removable weights, embedded weights, or a steep crown angle, as described above relative to the head CG position.

In many embodiments, the club head 100 comprises a crown-to-sole moment of inertia $I_{xx}$ greater than approximately 2250 g·cm$^2$, greater than approximately 2500 g·cm$^2$, greater than approximately 2750 g·cm$^2$, greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a heel-to-toe moment of inertia $I_{yy}$ greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a combined moment of inertia (i.e. the sum of the crown-to-sole moment of inertia $I_{xx}$ and the heel-to-toe moment of inertia $I_{yy}$) greater than approximately 7000 g·cm$^2$, greater than approximately 7250 g·cm$^2$, greater than approximately 7500 g·cm$^2$, greater than approximately 7750 g·cm$^2$, greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$, greater than 12500 g·cm$^2$, greater than 1300 g·cm$^2$, greater than 13500 g·cm$^2$, or greater than 14000 g·cm$^2$.

In many embodiments, the club head 100 comprises a head CG height 174 less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches. Further, in many embodiments, the club head 100 comprises a head CG height 374 having an absolute value less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches.

In many embodiments, the club head 100 comprises a head CG depth 172 greater than approximately 1.2 inches, greater than approximately 1.3 inches, greater than approximately 1.4 inches, greater than approximately 1.5 inches, greater than approximately 1.6 inches, greater than approximately 1.7 inches, greater than approximately 1.8 inches, greater than approximately 1.9 inches, or greater than approximately 2.0 inches.

In some embodiments, the club head 100 can comprise a first performance characteristic. The first performance characteristic is defined as a ratio between (a) the difference between 72 mm and the face height 144, and (b) the head CG depth 172. In most embodiments, the first performance characteristic is less than or equal to 0.56. However, in some embodiments, the first performance characteristic is less than or equal to 0.60, less than or equal to 0.65, less than or equal to 0.70, or less than or equal to 0.75.

In some embodiments, the club head 100 can comprise a second performance characteristic. The second performance characteristic is defined as the sum of (a) the volume of the club head 100, and (b) a ratio between the head CG depth 172 and the absolute value of the head CG height 174. The second performance characteristic is greater than or equal to 425 cc, wherein the second performance characteristic In some embodiments, the second performance characteristic can be greater than or equal to 450 cc, greater than or equal to 475 cc, greater than or equal to 490 cc, greater than or equal to 495 cc, greater than or equal to 500 cc, greater than or equal to 505 cc, or greater than or equal to 510 cc.

The club head 100 having the reduced head CG height 174 can reduce the backspin of a golf ball on impact compared to a similar club head having a higher head CG height. In many embodiments, reduced backspin can increase both ball speed and travel distance for improve club head performance. Further, the club head 100 having the increased head CG depth 172 can increase the heel-to-toe moment of inertia compared to a similar club head having a head CG depth closer to the strikeface. Increasing the heel-to-toe moment of inertia can increase club head forgiveness on impact to improve club head performance. Further still, the club head 100 having the increased head CG depth 172 can increase launch angle of a golf ball on impact by increasing the dynamic loft of the club head at delivery, compared to a similar club head having a head CG depth closer to the strikeface.

The head CG height 174 and/or head CG depth 172 can be achieved by reducing weight of the club head in various regions, thereby increasing discretionary weight, and repositioning discretionary weight in strategic regions of the club head to shift the head CG lower and farther back. Various means to reduce and reposition club head weight are described below.

i. Thin Regions

In some embodiments, the head CG height 174 and/or head CG depth 172 can be achieved by thinning various regions of the club head 100 to remove excess weight. Removing excess weight results in increased discretionary weight that can be strategically repositioned to regions of the club head 100 to achieve the desired low and back club head CG position.

In many embodiments, the club head 100 can have one or more thin regions 176. The one or more thin regions 176 can be positioned on the strikeface 104, the body 102, or a combination of the strikeface 104 and the body 102. Further, the one or more thin regions 176 can be positioned on any region of the body 102, including the crown 116, the sole 118, the heel 120, the toe 122, the front end 108, the back end 110, the skirt 128, or any combination of the described positions. For example, in some embodiments, the one or more thin regions 176 can be positioned on the crown 116. For further example, the one or more thin regions 176 can be positioned on a combination of the strikeface 104 and the crown 106. For further example, the one or more thin regions 176 can be positioned on a combination of the strikeface 104, the crown 116, and the sole 118. For further example, the entire body 102 and/or the entire strikeface 104 can comprise a thin region 176.

In embodiments where one or more thin regions 176 are positioned on the strikeface 104, the thickness of the strikeface 104 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, or less than 0.03 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions 176 are positioned on the body 102, the thin regions can comprise a thickness less than approximately 0.020 inches. In other embodiments, the thin regions comprise a thickness less than 0.025 inches, less than 0.020 inches, less than 0.019 inches, less than 0.018 inches, less than 0.017 inches, less than 0.016 inches, less than 0.015 inches, less than 0.014 inches, less than 0.013 inches, less than 0.012 inches, or less than 0.010 inches. For example, the thin regions can comprise a thickness between approximately 0.010-0.025 inches, between approximately 0.013-0.020 inches, between approximately 0.014-0.020 inches, between approximately 0.015-0.020 inches, between approximately 0.016-0.020 inches, between approximately 0.017-0.020 inches, or between approximately 0.018-0.020 inches.

In the illustrated embodiment, the thin regions 176 vary in shape and position and cover approximately 25% of the surface area of club head 100. In other embodiments, the thin regions can cover approximately 20-30%, approximately 15-35%, approximately 15-25%, approximately 10-25%, approximately 15-30%, or approximately 20-50% of the surface area of club head 900. Further, in other embodiments, the thin regions can cover up to 5%, up to 10%, up to 15%, up to 20%, up to 25%, up to 30%, up to 35%, up to 40%, up to 45%, or up to 50% of the surface area of club head 100.

In many embodiments, the crown 116 can comprise one or more thin regions 176, such that approximately 51% of the surface area of the crown 16 comprises thin regions 176. In other embodiments, the crown 116 can comprise one or more thin regions 176, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the crown 116 comprises thin regions 176. For example, in some embodiments, approximately 40-60% of the crown 116 can comprise thin regions 176. For further example, in other embodiments, approximately 50-100%, approximately 40-80%, approximately 35-65%, approximately 30-70%, or approximately 25-75% of the crown 116 can comprise thin regions 176. In some embodiments, the crown 116 can comprise one or more thin regions 176, wherein each of the one or more thin regions 176 become thinner in a gradient fashion. In this exemplary embodiment, the one or more thin regions 176 of the crown 116 extend in a heel-to-toe direction, and each of the one or more thin regions 176 decrease in thickness in a direction from the strikeface 104 toward the back end 110.

In many embodiments, the sole 118 can comprise one or more thin regions 176, such that approximately 64% of the surface area of the sole 118 comprises thin regions 176. In other embodiments, the sole 118 can comprise one or more thin regions 176, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the sole 118 comprises thin regions 176. For example, in some embodiments, approximately 40-60% of the sole 118 can comprise thin regions 176. For further example, in other embodiments, approximately 50-100%, approximately 40-80%, approximately 35-65%, approximately 30-70%, or approximately 25-75% of the sole 118 can comprise thin regions 176.

The thinned regions 176 can comprise any shape, such as circular, triangular, square, rectangular, ovular, or any other polygon or shape with at least one curved surface. Further, one or more thinned regions 176 can comprise the same shape as, or a different shape than the remaining thinned regions.

In many embodiments, club head 100 having thin regions can be manufacturing using centrifugal casting. In these embodiments, centrifugal casting allows the club head 100 to have thinner walls than a club head manufactured using conventional casting. In other embodiments, portions of the club head 100 having thin regions can be manufactured using other suitable methods, such as stamping, forging, or machining. In embodiments where portions of the club head 100 having thin regions are manufactured using stamping, forging, or machining, the portions of the club head 100 can be coupled using epoxy, tape, welding, mechanical fasteners, or other suitable methods.

ii. Optimized Materials

The golf club head 100 can further optimize CG height 174 and/or CG depth 172 using optimized materials in the strikeface 104 and/or the body 102. The optimized material can comprise increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability (such as portions of the strikeface 104 and/or body 102).

The golf club head 100 comprises a first material and a second material. In most embodiments, the strikeface 104 comprises the first material, while the body 102 comprises the second material. In most embodiments, the first material is different than the second material, however in some embodiments, the first material can be the same as the second material.

In some embodiments, the first material of the strikeface 104 can be an optimized material, as described in U.S. Provisional Patent Appl. No 62/399,929, entitled "Golf Club Heads with Optimized Material Properties," which is fully incorporated herein by reference. In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207 MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 304, or portions thereof, to be thinned, as described above, while maintaining durability. Thinning of the strikeface 304 can reduce the weight of the strikeface, thereby increasing discretionary weight to be strategically positioned in other areas of the club head 100 to position the head CG low and back and/or increase the club head moment of inertia.

In some embodiments, the second material of the body 102 can be an optimized material, as described in U.S. Provisional Patent Appl. No. 62/399,929, entitled "Golf Club Heads with Optimized Material Properties," which is incorporated herein by reference. In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In some embodiments, the second material can comprise a composite formed from polymer resin and reinforcing fiber or a composite material. The polymer resin can comprise a thermoset or a thermoplastic. More specifically, in embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, polyphenylene sulfides (PPS), polycarbonates, engineering polyurethanes, and/or other similar materials. The reinforcing fiber can comprise carbon fibers (or chopped carbon fibers), glass fibers (or chopped glass fibers), graphine fibers (or chopped graphite fibers), or any other suitable filler material. In other embodiments, the composite material can comprise beads (e.g. glass beads, metal beads) or powders (e.g., tungsten powder) for weighting. In other embodiments, the composite material may comprise any reinforcing filler that adds strength, durability, and/or weighting.

The polymer resin should preferably incorporate one or more polymers that have sufficiently high material strengths and/or strength/weight ratio properties to withstand typical use while providing a weight savings benefit to the design. Specifically, it is important for the design and materials to efficiently withstand the stresses imparted during an impact between the strikeface 104 and a golf ball, while not contributing substantially to the total weight of the golf club head 100. In general, the polymers can be characterized by a tensile strength at yield of greater than about 60 MPa. When the polymer resin is combined with the reinforcing fiber, the resulting composite material can have a tensile strength at yield of greater than about 110 MPa, greater than about 180 MPa, greater than about 220 MPa, greater than about 260 MPa, greater than about 280 MPa, or greater than about 290 MPa. In some embodiments, suitable composite materials may have a tensile strength at yield of from about 60 MPa to about 350 MPa.

In some embodiments, the reinforcing fiber comprises a plurality of distributed discontinuous fibers (i.e. "chopped fibers"). In some embodiments, the reinforcing fiber comprises a plurality of discontinuous "long fibers," having a designed fiber length of from about 3 mm to 25 mm. For example, in some embodiments, the fiber length is about 12.7 mm (0.5 inch) prior to the molding process. In another embodiment, the reinforcing fiber comprises discontinuous "short fibers," having a designed fiber length of from about 0.01 mm to 3 mm. In either case (short or long fiber), it should be noted that the given lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the composite material may have a fiber length of from about 0.01 mm to about 25 mm.

The composite material may have a polymer resin content of from about 40% to about 90% by weight, or from about 55% to about 70% by weight. The composite material of the second component can have a fiber content between about 10% to about 60% by weight. In some embodiments, the composite material has a fiber content between about 20% to about 50% by weight, between 30% to 40% by weight. In some embodiments, the composite material has a fiber content of between about 10% and about 15%, between about 15% and about 20%, between about 20% and about 25%, between about 25% and about 30%, between about 30% and about 35%, between about 35% and about 40%, between about 40% and about 45%, between about 45% and about 50%, between about 50% and about 55%, or between about 55% and about 60% by weight.

The density of the composite material, which forms the second component, can range from about 1.15 g/cc to about 2.02 g/cc. In some embodiments, the composite material density ranges between about 1.30 g/cc and about 1.40 g/cc, or between about 1.40 g/cc to about 1.45 g/cc. The composite material can have a melting temperature of between about 210° C. to about 280° C. In some embodiments, the composite material can have a melting temperature of between about 250° C. and about 270° C.

In some embodiments, the composite material comprises a long fiber reinforced TPU. The long fiber TPU can comprise about 40% long carbon fiber by weight. The long fiber TPU can exhibit a high elastic modulus, greater than that of short carbon fiber compounds. The long fiber TPU can withstand high temperatures, making it suitable for use in a golf club head that is used and/or stored in a hot climate. The long fiber TPU further exhibits a high toughness, allowing it to serve well as a replacement for traditionally metal components. In some embodiments, the long fiber TPU comprises a tensile modulus between about 26,000 MPa and about 30,000 MPa or between about 27,000 MPa and about 29,000 MPa. In some embodiments, the long fiber TPU comprises a flexural modulus between about 21,000 MPa and about 26,000 MPa or between about 22,000 MPa and 25,000 MPa. The long fiber TPU material can exhibit a tensile elongation (at break) of between about 0.5% and about 2.5%. In some embodiments, the tensile elongation of the composite TPU material can be between about 1.0% and about 2.0%, between about 1.2% and about 1.4%, between about 1.4% and about 1.6%, between about 1.6% and about 1.8%, between about 1.8% and about 2.0%.

Although strength and weight are the two main properties under consideration for the composite material, a suitable composite material may also exhibit secondary benefits. For example, PPS and PEEK are two exemplary thermoplastic polymers that meet the strength and weight requirements of the present design. Unlike many other polymers, however, the use of PPS or PEEK is further advantageous due to their unique acoustic properties. Specifically, in many circumstances, PPS and PEEK emit a generally metallic-sounding acoustic response when impacted. As such, by using a PPS or PEEK polymer, the present design can leverage the strength/weight benefits of the polymer, while not compromising the desirable metallic club head sound at impact.

In many embodiments, the second material of the golf club head 100 can be injection molded. The second material can be injection molded out of one composite material comprising both the polymer resin and the reinforcing fibers, in order to form the body portion 102. The reinforcing fibers can be embedded within the resin prior to molding the second component. The composite material including both the resin and the fibers can be provided in pellet form. The pellets can be melted and injected into an empty mold to form the second component. In other embodiments, the second component can be extruded, injection blow molded, 3-D printed, or any other appropriate forming means.

In embodiments that employ injection molding, the temperature of the mold used for forming the second component from the composite material can ideally be held between about 60° C. and 90° C. For example, the temperature of the mold can be about 75° C. In alternate embodiments, the second material may comprise fiber reinforced composite (FRC) materials. FRC materials generally include one or more layers of a uni- or multi-directional fiber fabric that extend across a larger portion of the polymer. Unlike the reinforcing fibers that may be used in filled thermoplastic (FT) materials, the maximum dimension of fibers used in FRCs may be substantially larger/longer than those used in FT materials, and may have sufficient size and characteristics so they may be provided as a continuous fabric separate from the polymer. When formed with a thermoplastic polymer, even if the polymer is freely flowable when melted, the included continuous fibers are generally not.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into a final shape.

The second material may be substantially formed from a formed fiber reinforced composite material that comprises a woven glass or carbon fiber reinforcing layer embedded in a polymeric matrix. In such an embodiment, the polymeric matrix is preferably a thermoplastic material. In some embodiments, the thermoplastic material is a thermoplastic polyurethane (TPU), such as polyphenylene sulfide (PPS), polyether ether ketone (PEEK), or a polyamide such as PA6 or PA66. In other embodiments, the second material may instead be formed from a filled thermoplastic material that comprises a glass bead or discontinuous glass, carbon, or aramid polymer fiber filler embedded throughout the thermoplastic material. The thermoplastic material (base resin) can be a TPU, such as polyphenylene sulfide (PPS), polyether ether ketone (PEEK), or polyamide. In still other embodiments, the second material, forming the body 102, may have a mixed-material construction that includes both a filled thermoplastic material and a formed fiber reinforced composite material.

The body 102 may have a mixed-material construction that includes both a fiber reinforced thermoplastic composite resilient layer (not shown) and a molded thermoplastic structural layer (not shown). In some preferred embodiments, the molded thermoplastic structural layer may be formed from a filled thermoplastic material that comprises a glass bead or discontinuous glass, carbon, or aramid polymer fiber filler embedded throughout a thermoplastic material. The thermoplastic material can be a TPU, such as, polyphenylene sulfide (PPS), polyether ether ketone (PEEK), or a polyamide such as PA6 or PA66. The resilient layer may then comprise a woven glass, carbon fiber, or aramid polymer fiber reinforcing layer embedded in a thermoplastic polymeric matrix. The thermoplastic polymeric matrix can comprise a TPU, such as a polyphenylene sulfide (PPS), a polyether ether ketone (PEEK), or a polyamide such as PA6 or PA66. In one particular embodiment, the body 102 resilient layer may comprise a woven carbon fiber fabric embedded in a polyphenylene sulfide (PPS), and the body 102 structural layer may comprise a filled polyphenylene sulfide (PPS) polymer.

In these embodiments, the increased specific strength and/or increased specific flexibility of the optimized second material allow the body 102, or portions thereof, to be thinned, while maintaining durability. Thinning of the body can reduce club head weight, thereby increasing discretionary weight to be strategically positioned in other areas of the club head 100 to position the head CG low and back and/or increase the club head moment of inertia.

iii. Removable Weights

In some embodiments, the club head 100 can include one or more weight structures 180 comprising one or more removable weights 182. The one or more weight structures 180 and/or the one or more removable weights 182 can be located towards the sole 118 and towards the back end 110, thereby positioning the discretionary weight on the sole 118 and near the back end 110 of the club head 100 to achieve a low and back head CG position. In some embodiments, the one or more weight structures 180 can be located at the high toe 122, near the crown 116, as well as the low heel 120, near the sole 118, in order to increase to Ixy product of inertia, balance the Ixz product of inertia, and maintain a low CG with a high MOI. In many embodiments, the one or more weight structures 180 removably receive the one or more removable weights 182. In these embodiments, the one or more removable weights 182 can be coupled to the one or more weight structures 180 using any suitable method, such as a threaded fastener, an adhesive, a magnet, a snap fit, or any other mechanism capable of securing the one or more removable weights to the one or more weight structures.

The weight structure 180 and/or removable weight 182 can be located relative to a clock grid 2000, which can be aligned with respect to the strikeface 104 when viewed from a top or bottom view (FIG. 3). The clock grid comprises at least a 12 o'clock ray, a 2 o'clock ray, a 3 o'clock ray, a 4 o'clock ray, a 5 o'clock ray, a 6 o'clock ray, a 7 o'clock ray, an 8 o'clock ray, a 9 o'clock ray, a 10 o'clock ray, and an 11 o'clock ray. For example, the clock grid 2000 comprises a 12 o'clock ray 2012, which is aligned with the geometric center 140 of the strikeface 104. The 12 o'clock ray 2012 is orthogonal to the X'Y' plane. Clock grid 2000 can be centered along 12 o'clock ray 2012, at a midpoint between the front end 108 and back end 110 of the club head 100. In the same or other examples, a clock grid centerpoint 2010 can be centered proximate to a geometric centerpoint of golf club head 100 when viewed from a bottom view (FIG. 3). The clock grid 2000 also comprises a 3 o'clock ray 2003 extending towards the heel 120, and a 9 o'clock ray 2009 extending towards the toe 122 of the club head 100. Further, the clock grid 2000, extends entirely from the crown 116 to the sole, in the direction of the y-axis 1060. The clock grid 2000, parses the golf club head into 12 distinct sections of the golf club head 100.

In examples such as the present one (FIG. 3), the golf club head 100 comprises one or more weights 182 located between the 11 o'clock ray 2011 and the 9 o'clock ray 2009. In addition, the golf club head 100 can comprise one or more weights 182 located between the 3 o'clock ray 2003 and the 5 o'clock ray 2005. The one or more weights 182 can be positioned on the external surface of the club head (the crown or sole), but the one or more weights 182 can extend into an interior of, or be defined within, the club head 100. In some examples, the location of the weight structure 180 can be established with respect to a broader area. For instance, in such examples, the weight structure 180 and weight 182 can be located near the toe 122 and crown 116, at least partially bounded between the 11 o'clock ray 2011 and 9 o'clock ray 2009 of the clock grid 2000, as well as intersecting the 10 o'clock ray 2010. Further, in one example the weight structure 180 and weight 182 can be located near the heel 120 and the sole 118, at least partially bounded between the 3 o'clock ray 2003 and 5 o'clock ray 2005 of the clock grid 2000, as well as intersecting the 4 o'clock ray 2004. Theses weights can again be used to address a balance between a low and back CG, high MOI, maximized Ixy product of inertia, and balanced Ixz product of inertia.

In some embodiments, not shown, the golf club can have an additional weight between the 3 o'clock ray 2003 and the 9 o'clock ray, to lower (or deepen) the CG 170, or to increase the Ixx or Iyy moments of inertia. The balance of the moment of inertia, the products of inertia, and CG position, can be altered with the additional weights, to provide the desired inertia tensor and CG location. In some examples, an additional weight can be placed between the 4 o'clock ray 2004 and the 7 o'clock ray 2007, in order to deepen the CG 170, and increase the Iyy moment of inertia. In another example, an additional weight can be placed between the 5 o clock ray 2005 and the 8 o clock ray 2008

In the present example, the weight structure 180 protrudes inwards, towards the crown from the external contour of the sole 118. In some examples, the weight structure 180 can comprise a mass of approximately 2 grams to approximately 50 grams, and/or a volume of approximately 1 cc to approximately 30 cc. In other examples, the weight structure 180 can remain flush with the external contour of the body 102.

In many embodiments, the one or more weights 182 can comprise a mass of approximately 0.5 grams to approximately 30 grams and can be replaced with one or more other similar removable weights to adjust the location of the head CG 370. In the same or other examples, the weight center 186 can comprise at least one of a center of gravity of the one or more weights 182, and/or a geometric center of the one or more weights 182.

In one embodiment, in reference to FIGS. 19-22, a golf club head 300 comprises a heel weight assembly 330 and a toe weight assembly 331 attached to a body 302 (similar to body 102 of golf club 100). The heel weight assembly 330 and toe weight assembly 331 are attached to the body 302 via one or more apertures 332, which are positioned on the heel 320 and toe 322 side of the golf club head 100, respectively. The heel weight assembly 330 and the toe weight assembly 331 could be any configuration of weight systems including die-casted, co-molded, or embedded weight assemblies.

The heel weight assembly 330 and toe weight assembly 331 comprises a weight 333, and one or more stainless steel fasteners 335. The material of the weight, washers, and fasteners can be any metal such as, but not limited to tungsten, aluminum, titanium, steel, or stainless steel. This type of weight assembly is configured to be attached and/or coupled to the golf club head body before welding the strike face 304 to the body 302. The weight assembly can be attached or coupled to golf club head body after welding the strike face to the body. Thereby, enabling the weight 333 to be positioned within the interior cavity of the golf club head 300. This arrangement of the heel weight assembly 330 and toe weight assembly 331 provides an alternative method to overmolding, while still beneficially balancing product of inertia and center of gravity characteristics, as described above.

Referring to FIGS. 19-22, the weight 333 of the heel weight assembly 330 is approximately 22.3 grams. In other embodiments, the mass of the weight 333 can be between 1 gram and 30 grams. In some embodiments, the mass of the weight 333 can be 1 gram, 2 grams, 3, grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, or 30 grams.

Figure 19:
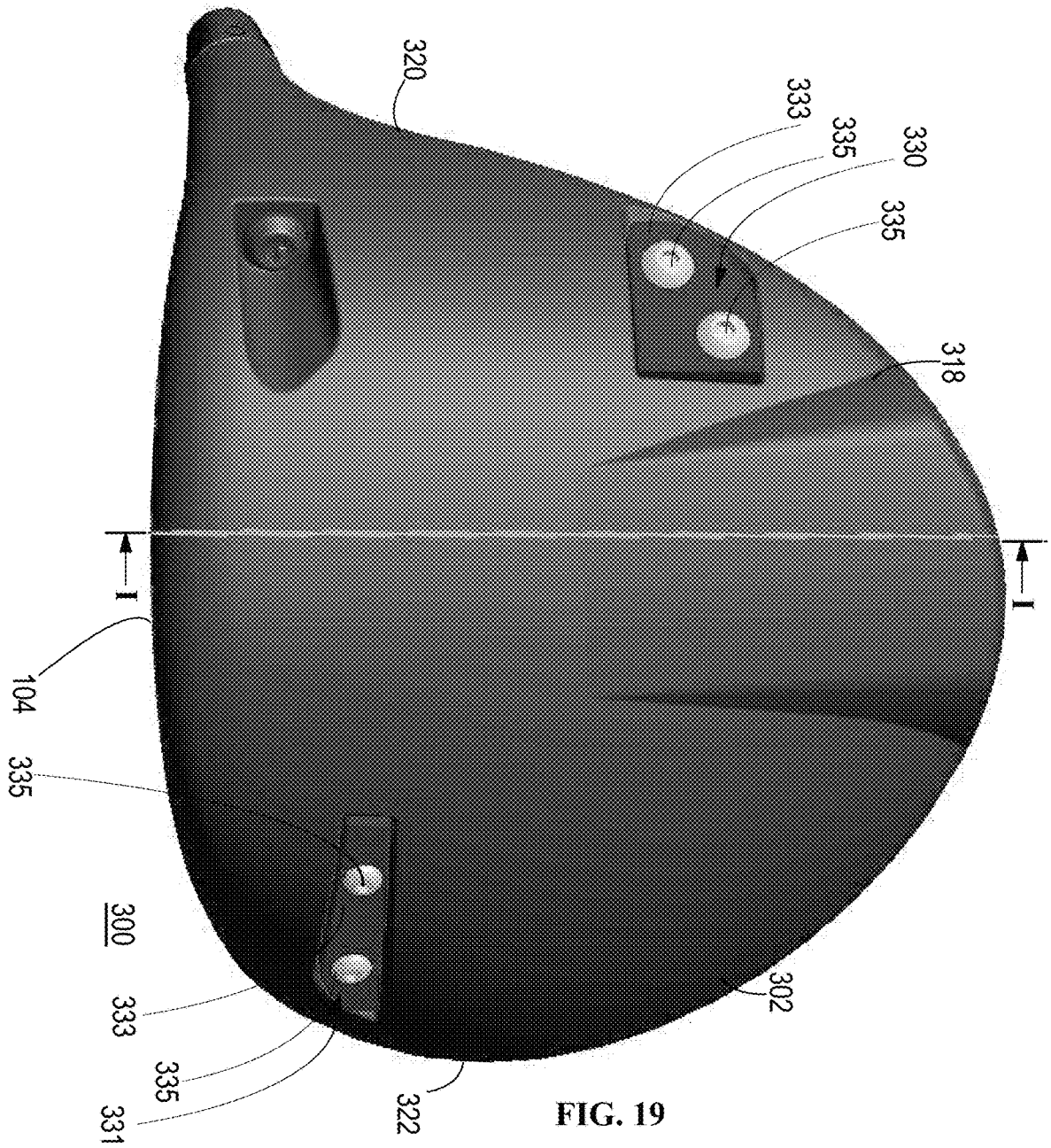
FIG. 19 illustrates a bottom view of an exemplary golf club head.
Figure 20:
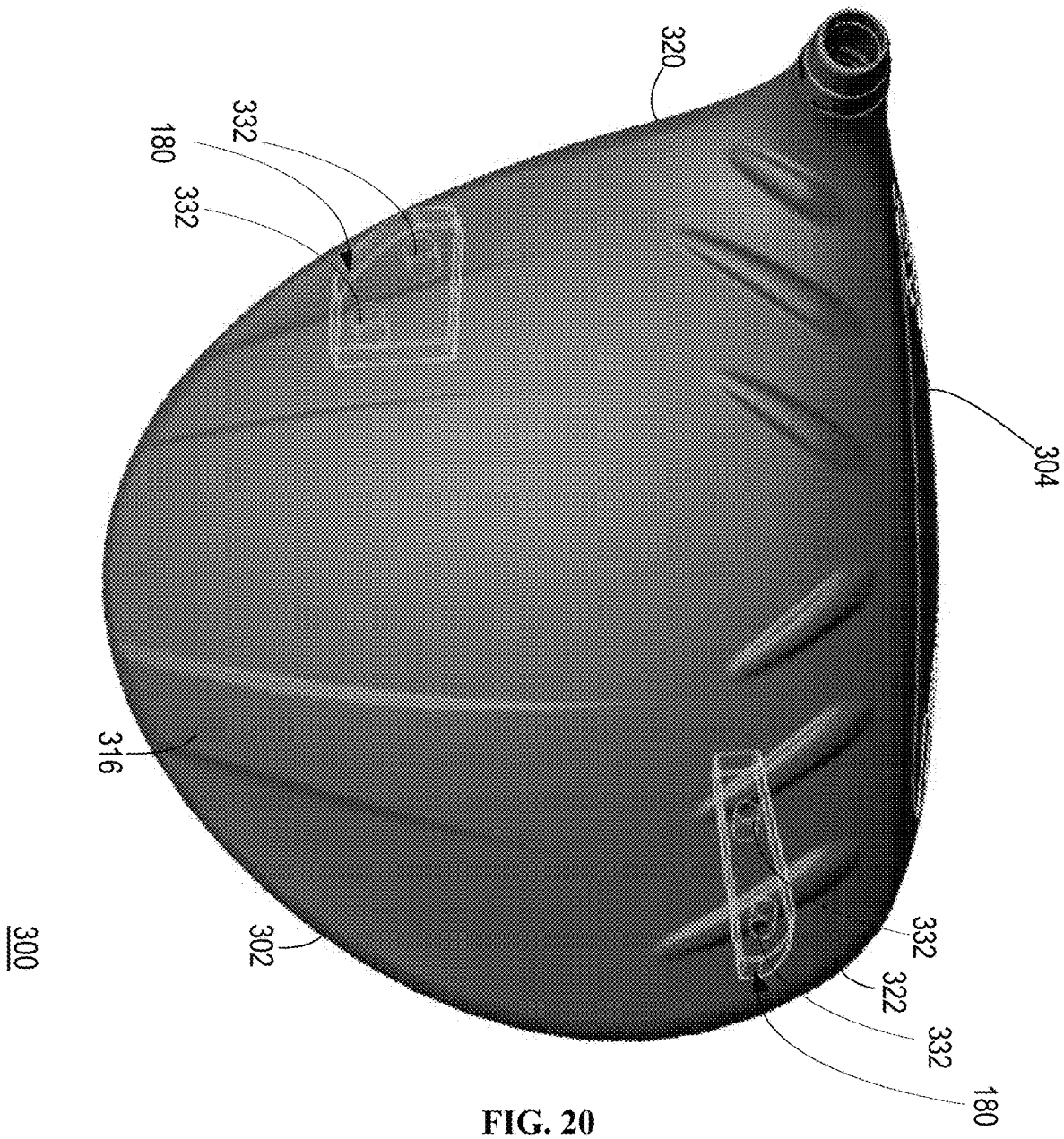
FIG. 20 illustrates a top view of the golf club head of FIG. 19.
Figure 21:
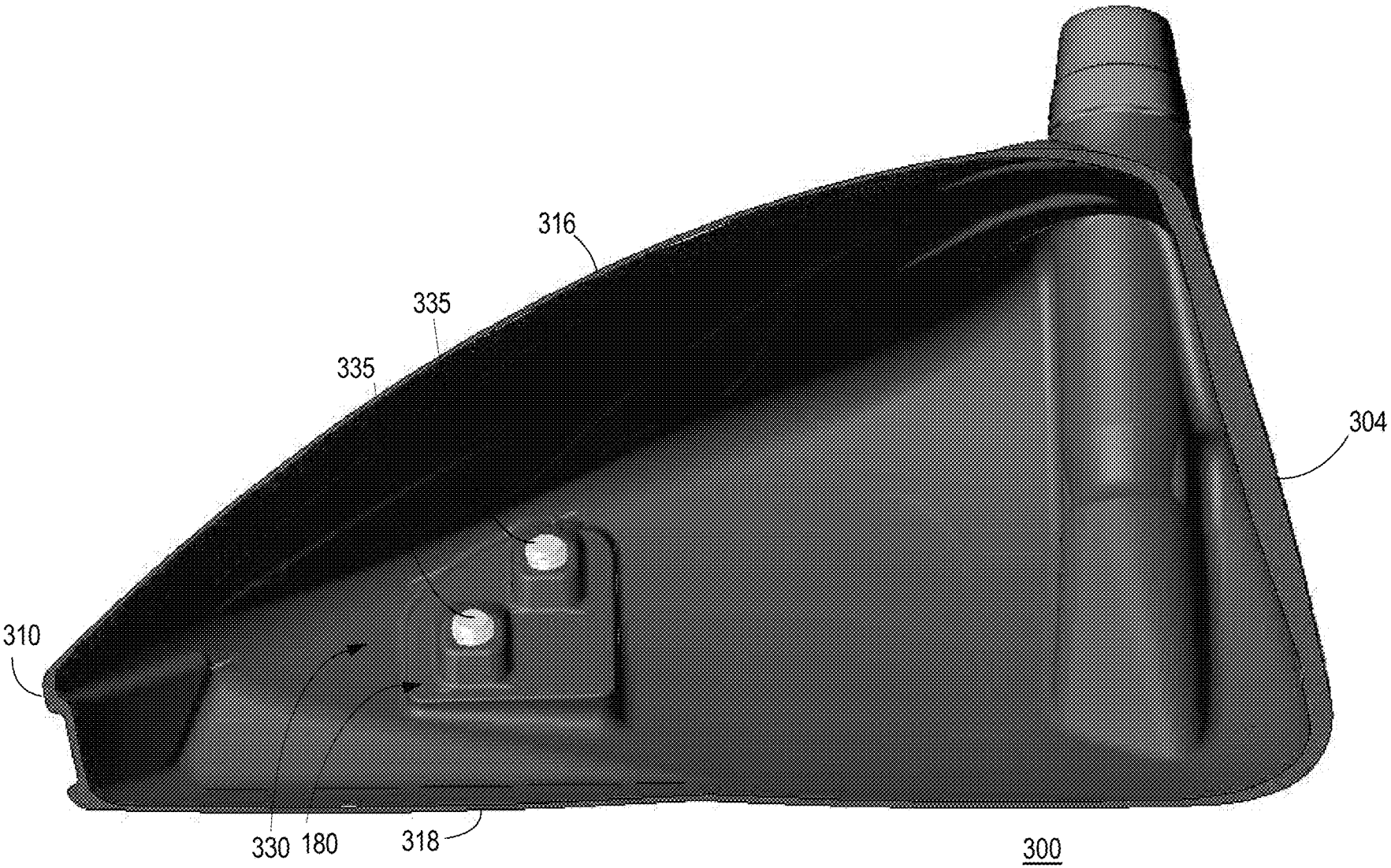
FIG. 21 illustrates a heel side cross sectional view, along cross-sectional line I-I, of FIG. 19.
Figure 22:
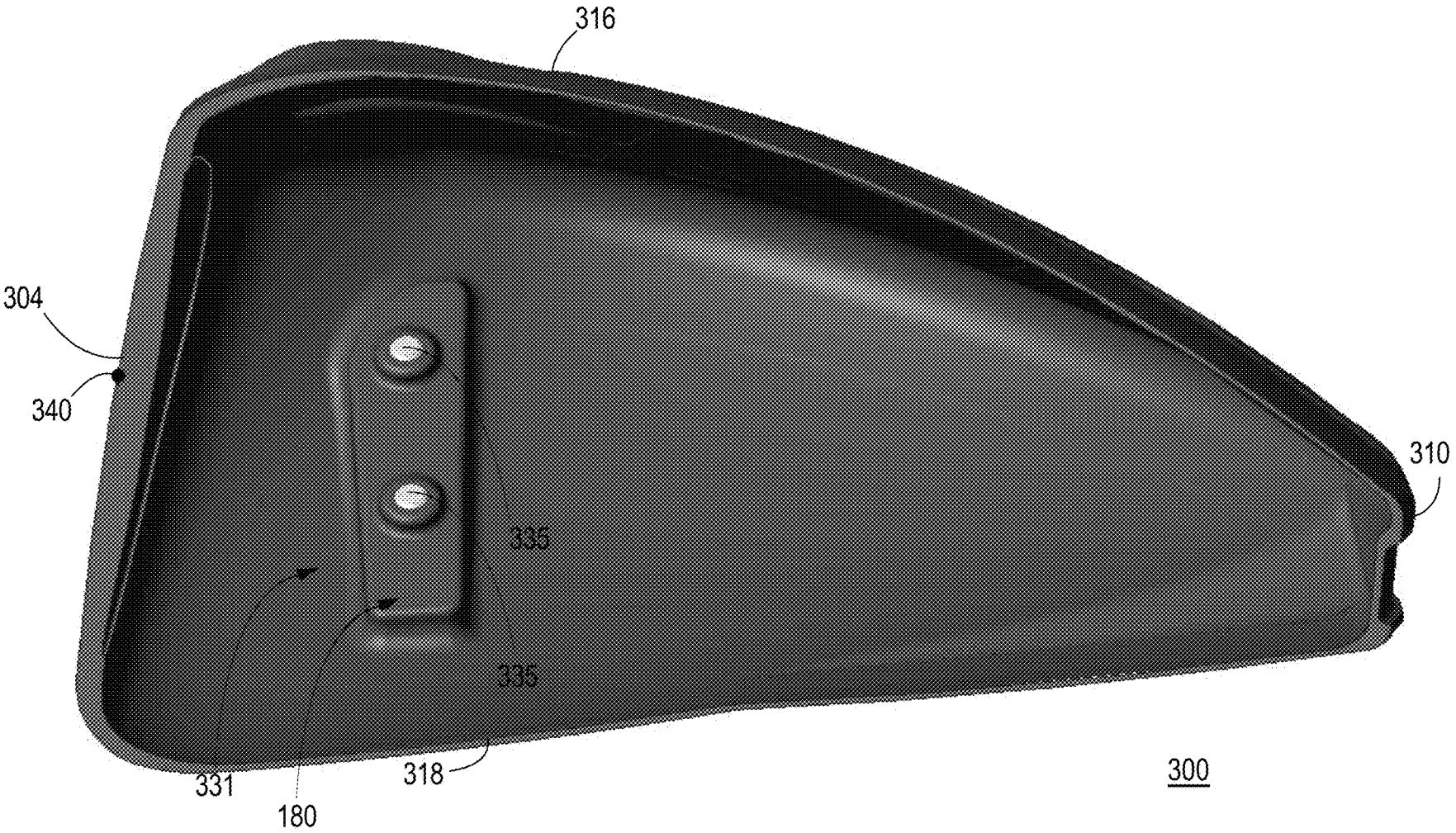
FIG. 22. illustrates a toe side cross sectional view, along cross-sectional line I-I, of FIG. 19.

With reference to FIGS. 19-22, the shape, geometry, and design of the weights 333 are configured to be bounded by the zones of the product of inertia. The further the weight is from the CG, the greater in magnitude the product of inertia will become. Therefore, in this case, the heel assembly 330 and toe assembly 331, are positioned extremely towards the high toe 322 and low heel 320, in order to maximize the Ixy product inertia, while balancing (or zeroing) the Ixz term of product of inertia. The golf club head 300 is similar in dimensions to golf club head 100, and comprises the same clock grid 2000, as mentioned in (FIG. 3). For example, FIGS. 19-21 illustrates the heel weight 333 being in a block like geometry, while FIGS. 19 and 22 illustrates the toe weight 333 being in a plate like geometry. In order to maximize the Ixy product of inertia, the toe weight 333 can be located near the toe 322 and crown 316, at least partially bounded between the 11 o'clock ray 2011 and 9 o'clock ray 2009 of the clock grid 2000, as well as intersecting the 10 o'clock ray 2010. Further, the heel weight 331 can be located near the heel 320 and the sole 318, at least partially bounded between the 3 o'clock ray 2003 and 5 o'clock ray 2005 of the clock grid 2000, as well as intersecting the 4 o'clock ray 2004.

The heel and toe weights 330, 331 are configured to be implemented on a casted titanium body 302. If the material of the golf club head body 302 changes the shape, dimensions, and geometry of the weights will be reconfigured to accurately satisfies the above identified product of inertia equations. For example, previously explained, if the body 102 is made from a second composite material, the heel and toe weights 331, 333 can be embedded (explained below) or adhered to the body 102, The weight 333 of the toe weight assembly 331 as illustrated in FIGS. 19-22 is approximately 10.8 grams. In other embodiments, the mass of the weight 333 can be between 1 gram and 30 grams. In some embodiments, the mass of the weight 333 can be 1 gram, 2 grams, 3, grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, 25 grams, 26 grams, 27 grams, 28 grams, 29 grams, and 30 grams.

iv. Embedded Weights

In some embodiments, the club head 100 can include one or more embedded weights 183, in combination with or instead of, having one or more removable weights 182. In many embodiments, the one or more embedded weights 183 are permanently fixed to or within the club head 300. In some embodiments, the embedded weight 183 can be similar to the high density metal piece (HDMP) described in U.S. Provisional Patent Appl. No. 62/372,870, entitled "Embedded High Density Casting." In some embodiments, when the body 102 comprises a composite, the one or more embedded weights 183 can be co-molded, over-molded, or adhered to the body 102.

In many embodiments, the one or more embedded weights 183 are positioned near the high toe 122, behind the strike face 104 (nearer the crown 116, than the sole 118) of the club head 100. In many embodiments, the one or more embedded weights 182 are positioned near the low heel 120 (nearer the sole 118 than the crown 116), close to the rear 110 of the club head 100. For instance, in such examples, the one or more weights 183 can be located near the toe 122 and crown 116, at least partially bounded between the 11 o'clock ray 2011 and 9 o'clock ray 2009 of the clock grid 2000, as well as intersecting the 10 o'clock ray 2010. Further, in one example the one or more weights 183 can be located near the heel 120 and the sole 118, at least partially bounded between the 3 o'clock ray 2003 and 5 o'clock ray 2005 of the clock grid 2000, as well as intersecting the 4 o'clock ray 2004.

In many embodiments, the one or more embedded weights 183 is positioned within 0.10 inches, within 0.20 inches, within 0.30 inches, within 0.40 inches, within 0.50 inches, within 0.60 inches, within 0.70 inches, within 0.80 inches, within 0.90 inches, within 1.0 inches, within 1.1 inches, within 1.2 inches, within 1.3 inches, within 1.4 inches, or within 1.5 inches of a perimeter of the club head 100 when viewed from a top or bottom view (FIG. 3). In these embodiments, the proximity of the embedded weight 183 to the perimeter of the club head 100 can maximize the low and back head CG position, the crown-to-sole moment of inertia $I_{xx}$, the Ixy, and/or the heel-to-toe moment of inertia $I_{yy}$.

In many embodiments, the one or more embedded weights 183 can comprise a mass between 3.0-50 grams. For example, in some embodiments, the one or more embedded weights 183 can comprise a mass between 3.0-25 grams, between 10-30 grams, between 20-40 grams, or between 30-50 grams. In embodiments where the one or more embedded weights 183 include more than one weight, each of the embedded weights 183 can comprise the same or a different mass.

In many embodiments, the one or more embedded weights 383 can comprise a material having a specific gravity between 6.0-22.0. For example, in many embodiments, the one or more embedded weights 183 can comprise a material having a specific gravity greater than 10.0, greater than 11.0, greater than 12.0, greater than 13.0, greater than 14.0, greater than 15.0, greater than 16.0, greater than 17.0, greater than 18.0, or greater than 19.0. In embodiments where the one or more embedded weights 183 include more than one weight, each of the embedded weights can comprise the same or a different material.

v. Steep Crown Angle

Figure 4:
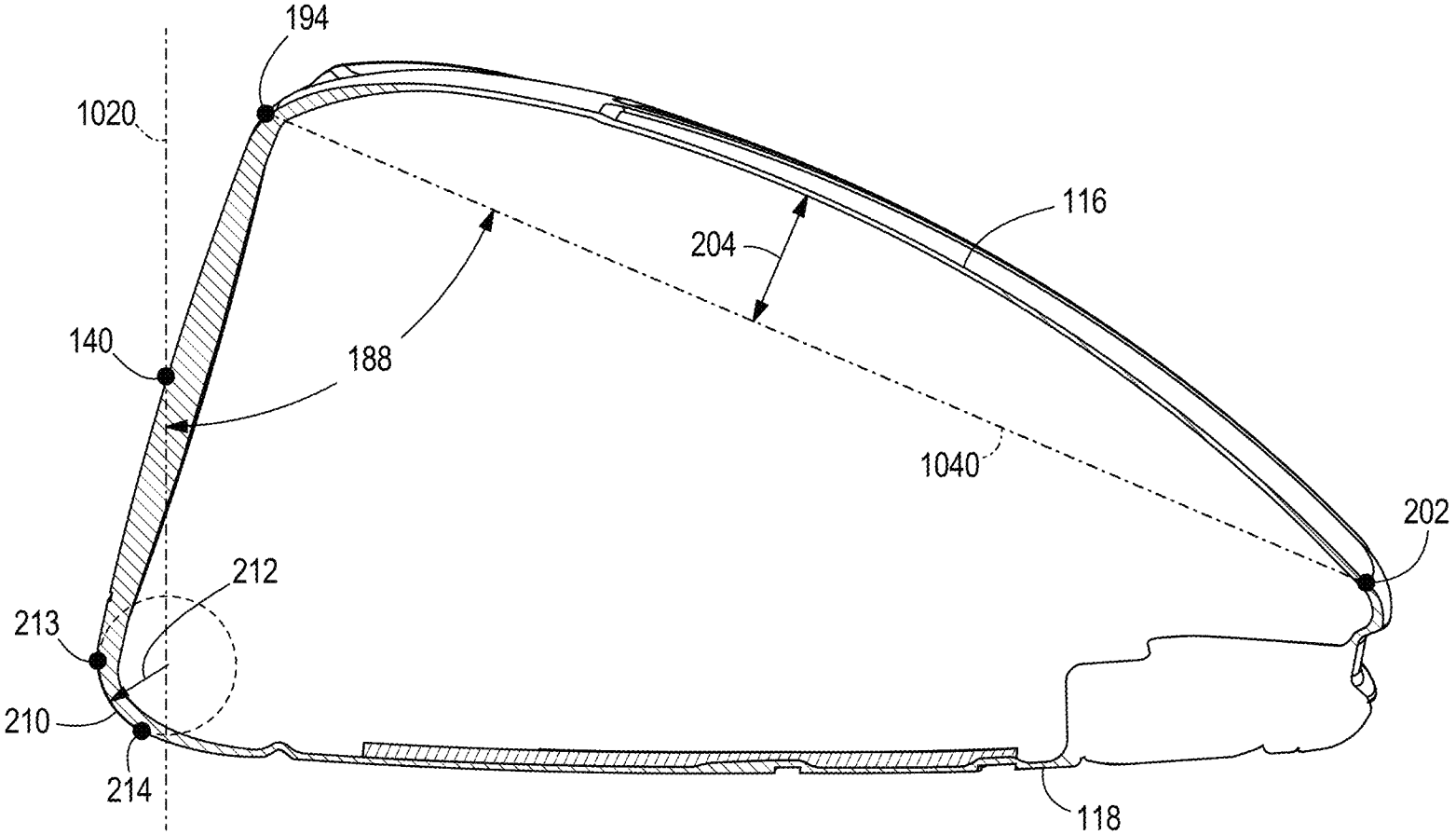
FIG. 4 is a side cross sectional view of the golf club head in FIG. 1.
Figure 5:
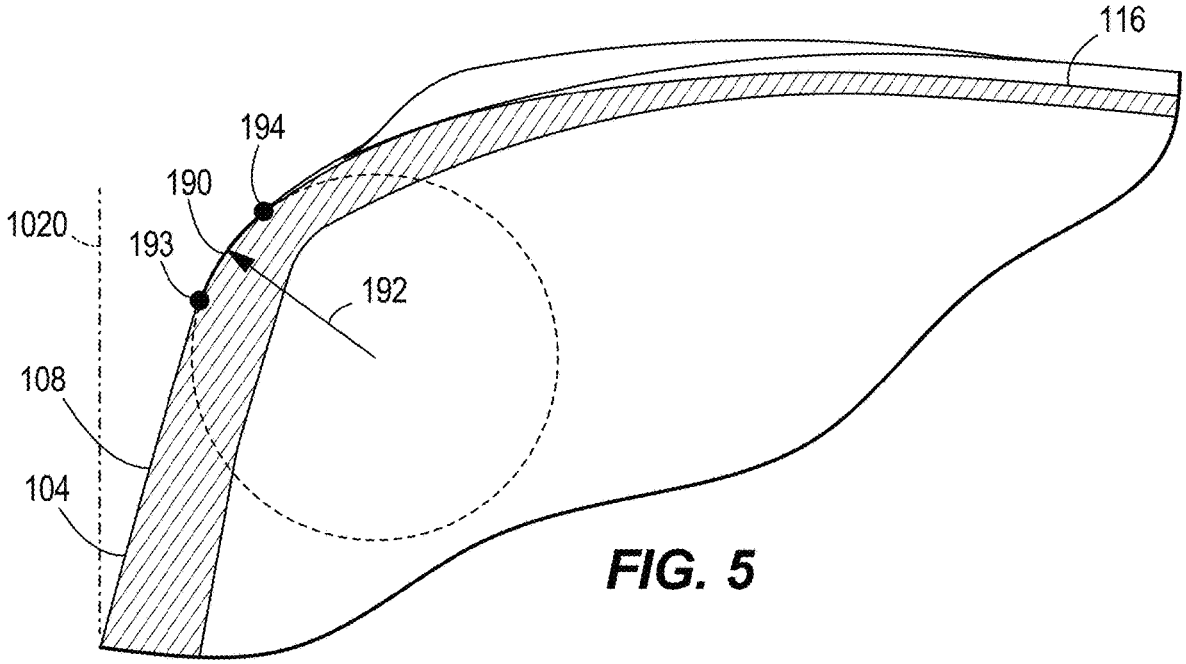
FIG. 5 is an enlarged side cross sectional view of the golf club head in FIG. 1.
Figure 6:
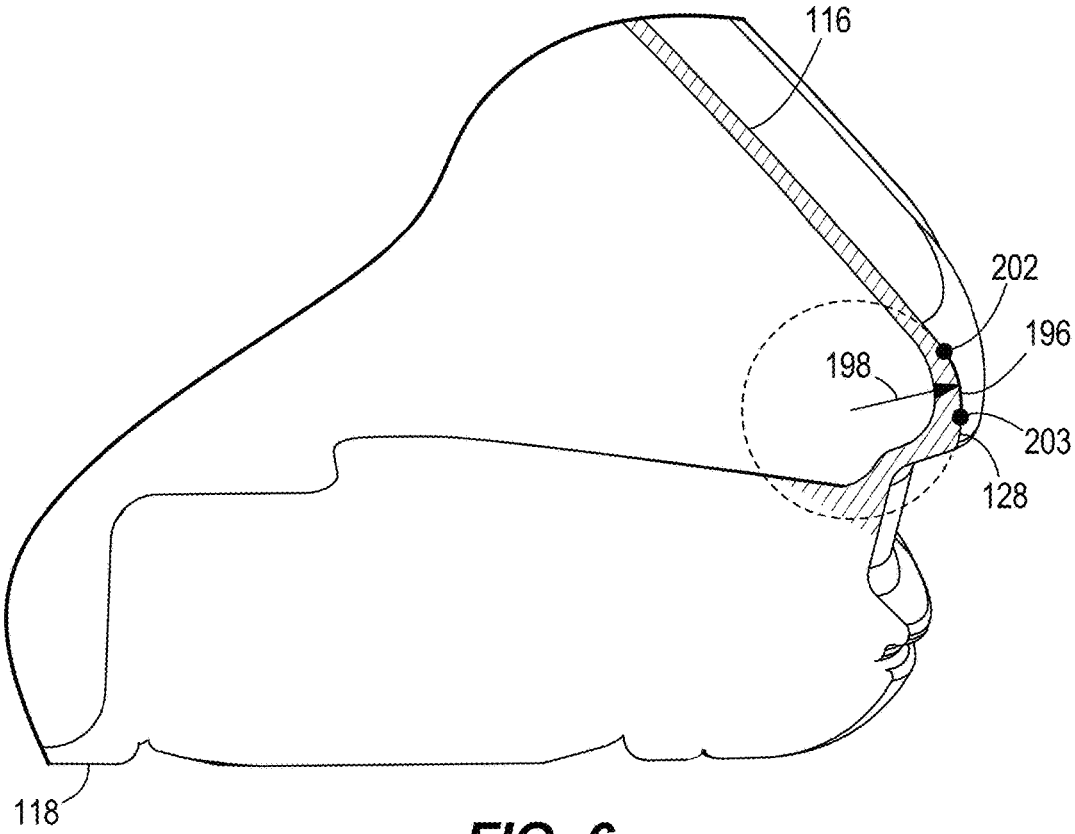
FIG. 6 is an enlarged side cross sectional view of the golf club head in FIG. 1.

Referring to FIGS. 4-6, in some embodiments, the golf club head 100 can further include a steep crown angle 188 to achieve the low and back head CG position. The steep crown angle 188 positions the back end of the crown 116 toward the sole 118 or ground, thereby lowering the club head CG position.

The crown angle 188 is measured as the acute angle between a crown axis 1090 and the front plane 1020. In these embodiments, the crown axis 1090 is located in a cross-section of the club head taken along a plane positioned perpendicular to the ground plane 1030 and the front plane 1020. The crown axis 1090 can be further described with reference to a top transition boundary and a rear transition boundary.

The club head 100 includes a top transition boundary extending between the front end 108 and the crown 116 from near the heel 120 to near the toe 122. The top transition boundary includes a crown transition profile 190 when viewed from a side cross sectional view taken along a plane perpendicular to the front plane 1020 and perpendicular to the ground plane 1030 when the club head 100 is at an address position. The side cross sectional view can be taken along any point of the club head 100 from near the heel 120 to near the toe 122. The crown transition profile 190 defines a front radius of curvature 192 extending from the front end 108 of the club head 100 where the contour departs from the roll radius and/or the bulge radius of the strikeface 104 to a crown transition point 194 indicating a change in curvature from the front radius of curvature 192 to the curvature of the crown 116. In some embodiments, the front radius of curvature 192 comprises a single radius of curvature extending from the top end 193 of the strikeface perimeter 142 near the crown 116 where the contour departs from the roll radius and/or the bulge radius of the strikeface 104 to a crown transition point 194 indicating a change in curvature from the front radius of curvature 192 to one or more different curvatures of the crown 116.

The club head 100 further includes a rear transition boundary extending between the crown 116 and the skirt 128 from near the heel 120 to near the toe 122. The rear transition boundary includes a rear transition profile 196 when viewed from a side cross sectional view taken along a plane perpendicular to the front plane 1020 and perpendicular to the ground plane 1030 when the club head 100 is at an address position. The cross sectional view can be taken along any point of the club head 100 from near the heel 120 to near the toe 122. The rear transition profile 196 defines a rear radius of curvature 198 extending from the crown 116 to the skirt 128 of the club head 100. In many embodiments, the rear radius of curvature 198 comprises a single radius of curvature that transitions the crown 116 to the skirt 128 of the club head 100 along the rear transition boundary. A first rear transition point 202 is located at the junction between the crown 116 and the rear transition boundary. A second rear transition point 203 is located at the junction between the rear transition boundary and the skirt 128 of the club head 100.

The front radius of curvature 192 of the top transition boundary can remain constant or can vary from near the heel 120 to near the toe 122 of the club head 100. Similarly, the rear radius of curvature 198 of the rear transition boundary can remain constant or can vary from near the heel 120 to near the toe 122 of the club head 100.

The crown axis 1090 extends between the crown transition point 194 near the front end 108 of the club head 100 and the rear transition point 202 near the back end 110 of the club head 100. The crown angle 188 can remain constant or can vary from near the heel 120 to near the toe 122 of the club head 100. For example, the crown angle 188 can vary when the side cross sectional view is taken at different locations relative to the heel 120 and the toe 122.

In the illustrated embodiment, the crown angle 188 near the toe 122 is approximately 72.25 degrees, the crown angle 188 near the heel 120 is approximately 64.5 degrees, and the crown angle 188 near the center of the golf club head is approximately 64.2 degrees. In many embodiments, the maximum crown angle 188 taken at any location from near the toe 122 to near the heel 120 is less than 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, in some embodiments, the maximum crown angle is between 50 degrees and 79 degrees, between 60 degrees and 79 degrees, or between 70 degrees and 79 degrees.

In other embodiments, the crown angle 188 near the toe 122 of the club head 100 can be less than approximately 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, the crown angle 188 taken along a side cross sectional view positioned approximately 1.0 inch toward the toe 122 from the geometric center 140 of the strikeface 104 can be less than 79 degrees, less than 78 degrees, less than 77 degrees, less than 76 degrees, less than 75 degrees, less than 74 degrees, less than 73 degrees, less than 72 degrees, less than 71 degrees, less than 70 degrees, less than 69 degrees, or less than 68 degrees.

Further, in other embodiments, the crown angle 188 near the heel 120 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 188 taken along a side cross sectional view positioned approximately 1.0 inch toward the heel 120 from the geometric center 140 of the strikeface 104 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

Further still, in other embodiments, the crown angle 188 near the center of the club head 100 can be less than 75 degrees, less than 74 degrees, less than 73 degrees, less than 72 degrees, less than 71 degrees, less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 188 taken along a side cross sectional view positioned approximately at the geometric center 140 of the strikeface 104 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

In many embodiments, reducing the crown angle 188 compared to current club heads generates a steeper crown or a crown positioned closer to the ground plane 1030 when the club head 100 is at an address position. Accordingly, the reduced crown angle 188 can result in a lower head CG position compared to a club head with a higher crown angle.

IV. Aerodynamic Drag

In many embodiments, the club head 100 comprises a low and back club head CG position, an increased club head moment of inertia, high Ixy product of inertia, in combination with reduced aerodynamic drag.

In many embodiments, the club head 100 experiences an aerodynamic drag force less than approximately 1.5 lbf, less than 1.4 lbf, less than 1.3 lbf, or less than 1.2 lbf when tested in a wind tunnel with a squared face and an air speed of 102 miles per hour (mph). In these or other embodiments, the club head 100 experiences an aerodynamic drag force less than approximately 1.5 lbf, less than 1.4 lbf, less than 1.3 lbf, or less than 1.2 lbf when simulated using computational fluid dynamics with a squared face and an air speed of 102 miles per hour (mph). In these embodiments, the airflow experienced by the club head 100 having the squared face is directed at the strikeface 104 in a direction perpendicular to the X'Y' plane. The club head 100 having reduced aerodynamic drag can be achieved using various means, as described below.

i. Crown Angle Height

In some embodiments, reducing the crown angle 188 to form a steeper crown and lower head CG position may result in an undesired increase in aerodynamic drag due to increased air flow separation over the crown during a swing. To prevent increased drag associated with a reduced crown angle 188, a maximum crown height 204 can be increased. Referring to FIG. 4, the maximum crown height 204 is the greatest distance between the surface of the crown 116 and the crown axis 1090 taken at any side cross sectional view of the club head 100 along a plane positioned parallel to the Y'Z' plane. In many embodiments, a greater maximum crown height 204 results in the crown 116 having a greater curvature. A greater curvature in the crown 116 moves the location of the air flow separation during a swing further back on the club head 100. In other words, a greater curvature allows the airflow to stay attached to club head 100 for a longer distance along the crown 116 during a swing. Moving the airflow separation point back on the crown 116 can result in reduced aerodynamic drag and increased club head swing speeds, thereby resulting in increased ball speed and distance.

In many embodiments, the maximum crown height 204 can be greater than approximately 0.20 inch (5 mm), greater than approximately 0.30 inch (7.5 mm), greater than approximately 0.40 inch (10 mm), greater than approximately 0.50 inch (12.5 mm), greater than approximately 0.60 inch (15 mm), greater than approximately 0.70 inch (17.5 mm), greater than approximately 0.80 inch (20 mm), greater than approximately 0.90 inch (22.5 mm), or greater than approximately 1.0 inch (25 mm). Further, in other embodiments, the maximum crown height can be within the range of 0.20 inch (5 mm) to 0.60 inch (15 mm), or 0.40 inch (10 mm) to 0.80 inch (20 mm), or 0.60 inch (15 mm) to 1.0 inch (25 mm). For example, in some embodiments, the maximum crown height 404 can be approximately 0.52 inch (13.3 mm), approximately 0.54 inch (13.8 mm), approximately 0.59 inch (15 mm), approximately 0.65 inch (16.5 mm), or approximately 0.79 inch (20 mm).

ii. Transition Profiles

In many embodiments, the transition profiles of the club head 100 from the strikeface 104 to the crown 116, the strikeface 104 to the sole 118, and/or the crown 116 to the sole 118 along the back end 110 of the club head 100 can affect the aerodynamic drag on the club head 100 during a swing.

In some embodiments, the club head 100 having the top transition boundary defining the crown transition profile 190, and the rear transition boundary defining the rear transition profile 196 further includes a sole transition boundary defining a sole transition profile 210. The sole transition boundary extends between the front end 108 and the sole 118 from near the heel 120 to near the toe 122. The sole transition boundary includes a sole transition profile 210 when viewed from a side cross sectional view taken along a plane parallel to the Y'Z' plane. The side cross sectional view can be taken along any point of the club head 100 from near the heel 120 to near the toe 122. The sole transition profile 210 defines a sole radius of curvature 212 extending from the front end 108 of the club head 100 where the contour departs from the roll radius and/or the bulge radius of the strikeface 104 to a sole transition point 214 indicating a change in curvature from sole radius of curvature 212 to the curvature of the sole 118. In some embodiments, the sole radius of curvature 212 comprises a single radius of curvature extending from the bottom end 213 of the strikeface perimeter 142 near the sole 118 where the contour departs from the roll radius and/or the bulge radius of the strikeface 104 to a sole transition point 214 indicating a change in curvature from the sole radius of curvature 212 to a curvature of the sole 214.

In many embodiments, the crown transition profile 190, the sole transition profile 210, and the rear transition profile 196 can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 192 can be similar to the first crown radius of curvature, the sole radius of curvature 212 can be similar to the first sole radius of curvature, and the rear radius of curvature 198 can be similar to the rear radius of curvature described U.S. patent. Ser. No. 15/233,486, entitled "Golf Club Head with Transition Profiles to Reduce Aerodynamic Drag."

In some embodiments, front radius of curvature 192 can range from approximately 0.18 to 0.30 inches (0.46 to 0.76 cm). Further, in other embodiments, the front radius of curvature 192 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the front radius of curvature 192 may be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

In some embodiments, the sole radius of curvature 212 can range from approximately 0.25 to 0.50 inches (0.76 to 1.27 cm). For example, the sole radius of curvature 212 can be less than approximately 0.5 inches (1.27 cm), less than approximately 0.475 inches (1.21 cm), less than approximately 0.45 inches (1.14 cm), less than approximately 0.425 inches (1.08 cm), or less than approximately 0.40 inches (1.02 cm). For further example, the sole radius of curvature 212 can be approximately 0.30 inches (0.76 cm), 0.35 inches (0.89 cm), 0.40 inches (1.02 cm), 0.45 inches (1.14 cm), or 0.50 inches (1.27 cm).

In some embodiments, the rear radius of curvature 198 can range from approximately 0.10 to 0.25 inches (0.25 to 0.64 cm). For example, the rear radius of curvature 198 can be less than approximately 0.30 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm). For further example, the rear radius of curvature 398 can be approximately 0.10 inches (0.25 cm), 0.15 inches (0.38 cm), 0.20 inches (0.51 cm), or 0.25 inches (0.64 cm).

iii. Turbulators

Figure 7:
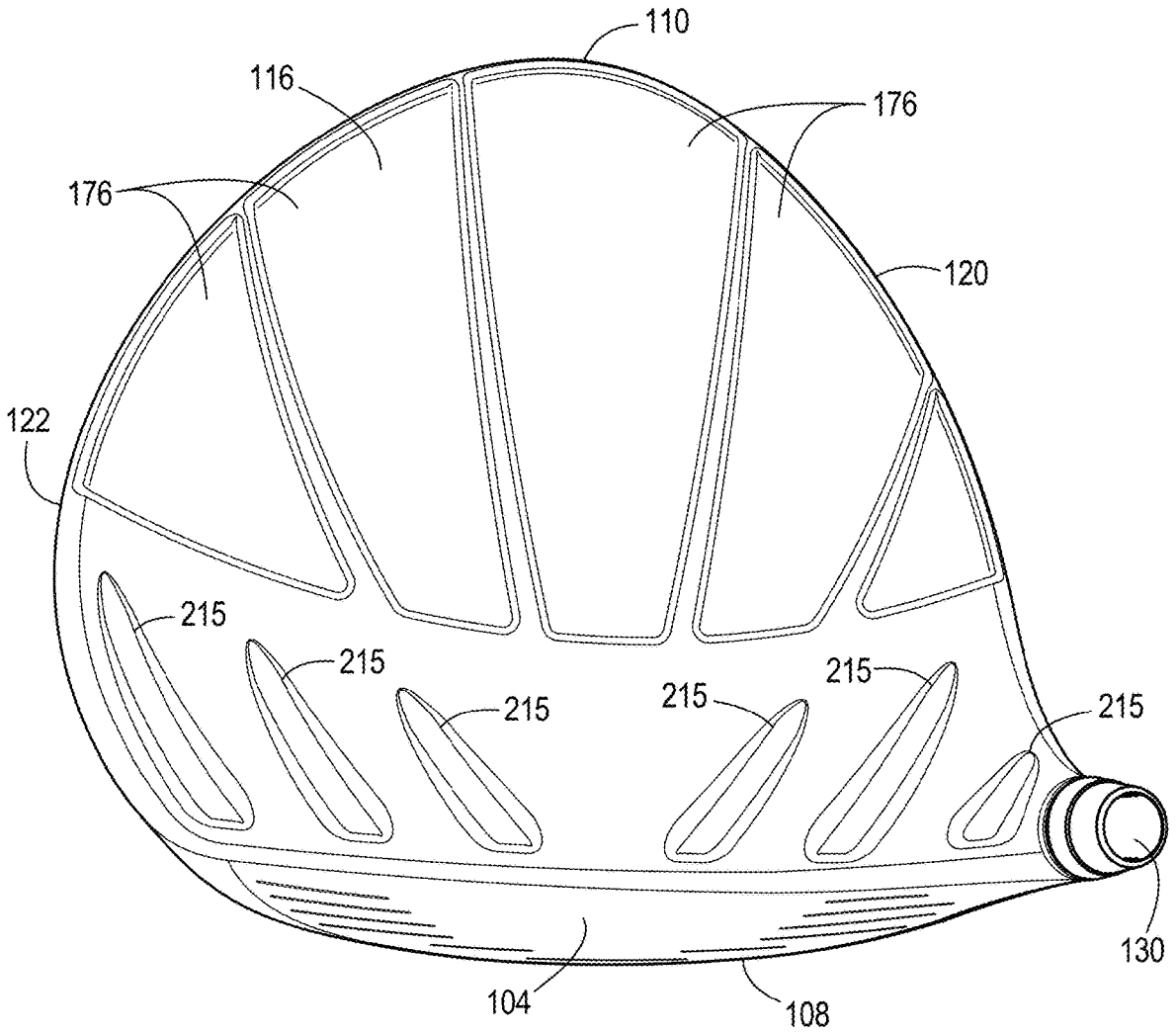
FIG. 7 is a top view of the golf club head in FIG. 1.

Referring to FIG. 7, in some embodiments, the club head 100 can further include a plurality of turbulators 215, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," which is incorporated fully herein by reference. In many embodiments, the plurality of turbulators 215 disrupt the airflow thereby creating small vortices or turbulence inside the boundary layer to energize the boundary layer and delay separation of the airflow on the crown 116 during a swing.

In some embodiments, the plurality of turbulators 215 can be adjacent to the crown transition point 194 of the club head 100. The plurality of turbulators 215 project from an outer surface of the crown 116 and include a length extending between the front end 108 and the back end 110 of the club head 100, and a width extending from the heel 120 to the toe 122 of the club head 100. In many embodiments, the length of the plurality of turbulators 215 is greater than the width. In some embodiments, the plurality of turbulators 215 can comprise the same width. In some embodiments, the plurality of turbulators 215 can vary in height profile. In some embodiments, the plurality of turbulators 215 can be higher toward the apex of the crown 116 than in comparison to the front of the crown 116. In other embodiments, the plurality of turbulators 215 can be higher toward the front of the crown 116, and lower in height toward the apex of the crown 116. In other embodiments, the plurality of turbulators 215 can comprise a constant height profile. Further, in many embodiments, at least a portion of at least one turbulator is located between the strikeface 104 and an apex of the crown 116, and the spacing between adjacent turbulators is greater than the width of each of the adjacent turbulators.

V. Balance of Products of Inertia, Moment of Inertia, CG Position, and Drag

The golf club described below uses several relations that balances the club head moment of inertia, products of inertia, with a down and back CG position, while simultaneously maintaining or reducing aerodynamic drag. Balancing these relationships of CG, moment of inertia, products of inertia, and drag improve impact performance characteristics (e.g. side spin prevention on high and low face hits, launch angle, ball speed, and forgiveness) and swing performance characteristics (e.g. aerodynamic drag, ability to square the club head at impact, swing speed). This balance is applicable to the driver-type club head 100.

a. Balance of Product of Inertia (Ixy Ratio) and CG Height

The Ixy Ratio (Equation 5 below) represents the symmetry of the club head 100 about the x-axis 1050, to the symmetry of the club head 100 about the y-axis 1060. The Ixy Ratio is the term of $\alpha_z$ that is multiplied against torque, thus it is the ultimate influencer on the resultant angular acceleration ($\alpha_y$) about the y-axis 1060. The larger the Ixy Ratio, the greater the club influences rotational velocity about the x-y axis of the club head 100, thus leading to more consistent impact characteristics (i.e., forgiveness when striking the ball off center), as the golf club head 100 rotates to counteract the sidespin created from differences in the face angle and club head path.

$$I_{xy}\text{Ratio} = \frac{I_{xy}}{I_{xx}I_{yy}} \tag{5}$$

In current golf club head designs, increasing the Ixy product of inertia, of the golf club head 100 can adversely affect other performance characteristics of the club head 100, such as CG height 174 (distance of the CG from midplane of the golf club head). The club head 100 described herein increases or maximizes the Ixy product of inertia of the club head, while simultaneously maintaining or reducing the CG height 174. Accordingly, the club head 100 having improved impact performance characteristics (e.g., spin, forgiveness, launch) also balances or improves swing performance characteristics (e.g. aerodynamic drag, ability to square the club at impact).

In order to increase Ixy, the optimal location to place the discretionary mass is in the high toe region (between the 11 o'clock ray and the 9 o'clock ray) and low heel region (between the 3 o'clock and 5 o'clock ray) of the golf club head 100. It is a known factor in the art, however, that the lower the CG height 174 is (closer to the sole), the better/more optimal the launch of the golf ball is at impact. The optimal location of the discretionary mass placement to increase Ixy, contradicts the optimal placement of the discretionary mass to lower the CG height 174 of the golf club head.

Figure 15:
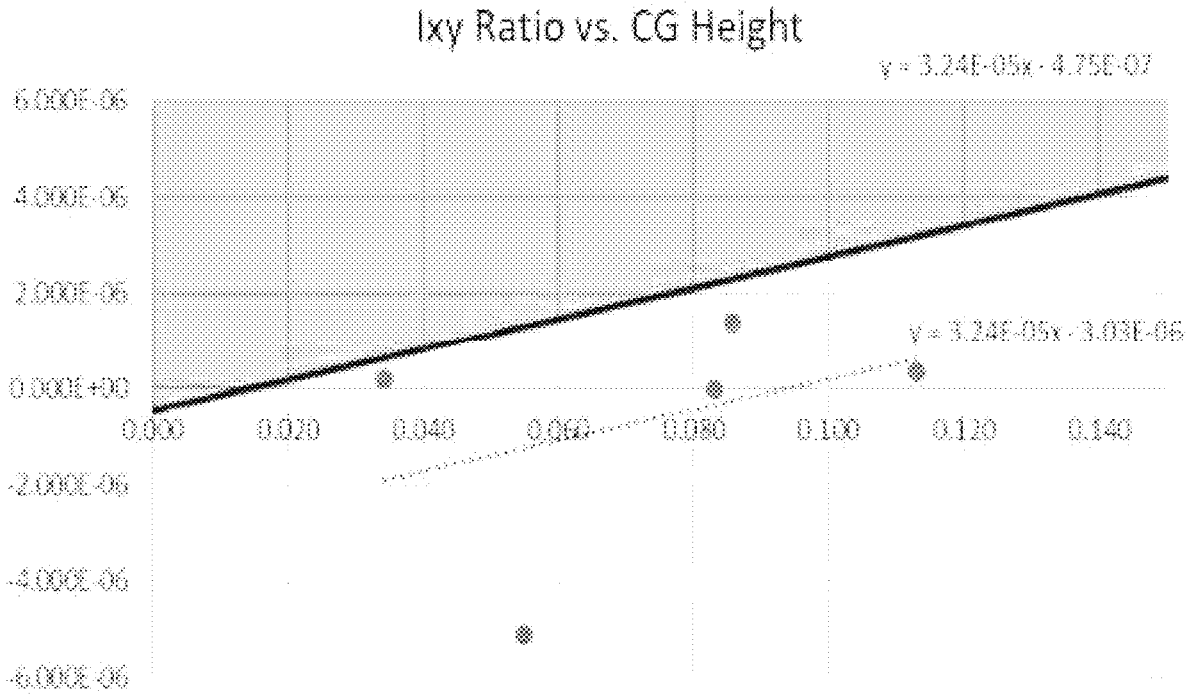
FIG. 15 illustrates a relationship between the Ixy ratio and the center of gravity height for various known golf club heads

Referring to FIG. 15, for many known club heads, as Ixy increases, the CG height increases. The club head 100 described herein increases or maximizes Ixy compared to known club heads having similar volume and/or loft angle, while simultaneously maintaining a desirable CG height 174. Accordingly, the club head 100 having improved impact performance characteristics (e.g., spin, forgiveness, launch) also balances and/or improves swing performance characteristics (e.g. aerodynamic drag, ability to square the club at impact).

$$\frac{I_{xy}\text{Ratio} + 4.75\times10^{-7}}{(3.24\times10^{-5})\times(CG_{Height})} > 1 \tag{i}$$

b. Balance of Product of Inertia (Ixz Ratio) and CG Depth

The Ixz Ratio (Equation 6 below) represents the symmetry of the club head 100 about the x-axis 1050, to the symmetry of the club head 100 about the z-axis 1070. The Ixz Ratio is the term of $\alpha_z$ that is multiplied against torque, thus it is the ultimate influencer on the resultant angular acceleration ($\alpha_z$) about the z-axis 1070. In order to create a balanced golf club head, the optimal magnitude of Ixz is zero. However, it is preferred, if zero cannot be achieved, that Ixz is nearest zero without being positive in magnitude.

$$I_{xz}\text{Ratio} = \frac{I_{xz}}{I_{xx}I_{zz}} \tag{6}$$

In current golf club head design, balancing the Ixz product of inertia (Ixz product of inertia to zero in magnitude), of the golf club head can adversely affect other performance characteristics of the club head, such as CG depth 172 (distance of the CG from the loft plane of the golf club head). The club head 100 described herein balances or zeros the Ixz product of inertia of the club head 100, while simultaneously maintaining a desirable CG depth 172. Accordingly, the club head 100 having improved impact performance characteristics (e.g., spin, forgiveness, launch) also balances or improves swing performance characteristics (e.g. aerodynamic drag, ability to square the club at impact).

In order to balance (or zero out) Ixz, the optimal location to place the discretionary mass is in the high toe region and low heel region of the golf club head 100. It is a known factor in the art, however, that the deeper the CG depth 172 is (further from the strike loft plane, towards the rear periphery of the club), the better/more optimal the launch of the golf ball is at impact. The optimal location of the discretionary mass, to balance Ixz, contradicts the optimal location of the discretionary mass to increase the CG depth 172 of the golf club head 100.

Figure 17:
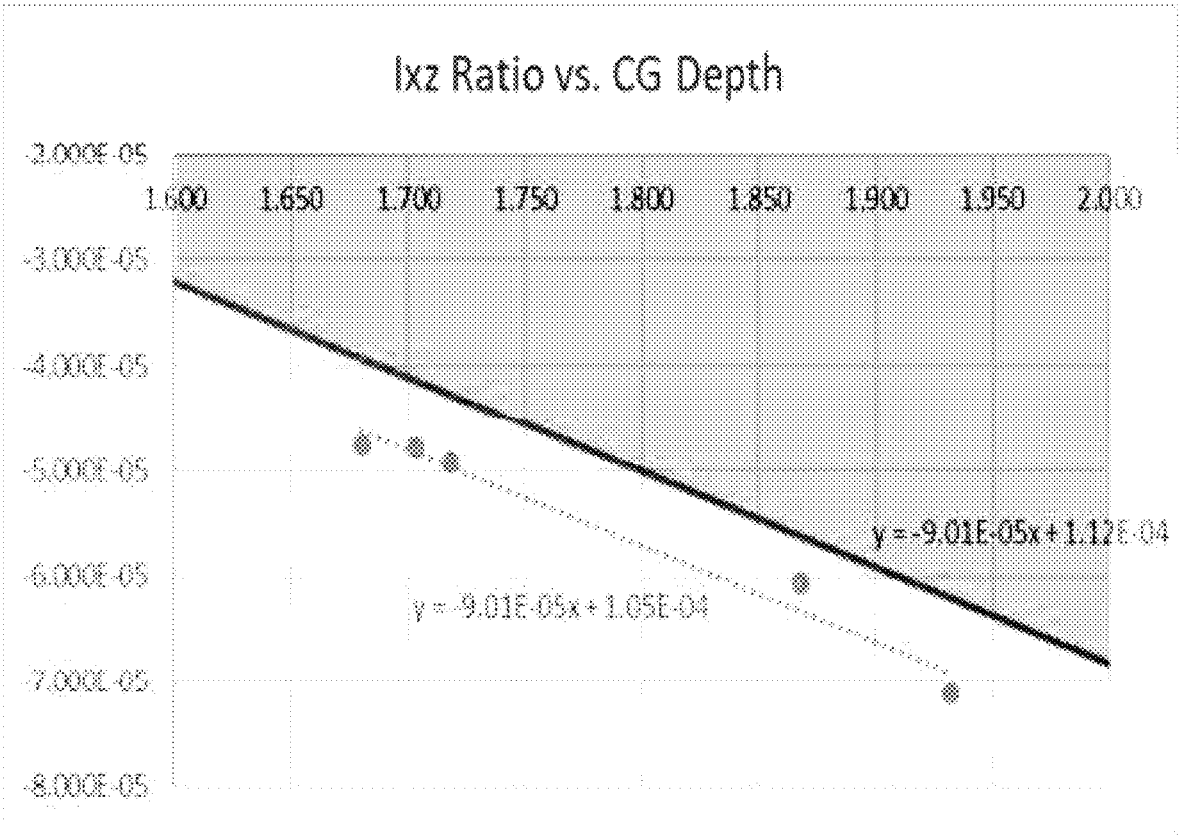
FIG. 17 illustrates a relationship between the Ixz ratio and the center of gravity height for various known golf club heads.

Referring to FIG. 17, for many known club heads, as Ixz nears zero, the CG depth 172 decreases. The club head 100 described herein balances or zeros the Ixz product of inertia compared to known club heads having similar volume and/or loft angle, while simultaneously maintaining desirable CG depth 172. Accordingly, the club head 100 having improved impact performance characteristics (e.g., spin, forgiveness, launch) also balances and/or improves swing performance characteristics (e.g. aerodynamic drag, ability to square the club at impact).

$$\frac{I_{xz}\text{Ratio} - 1.12\times10^{-4}}{(9.01\times10^{-5})\times(CG_d)} > 1 \tag{ii}$$

c. Balance of Product of Inertia (Ixy Ratio), Drag, and CG

Figure 16:
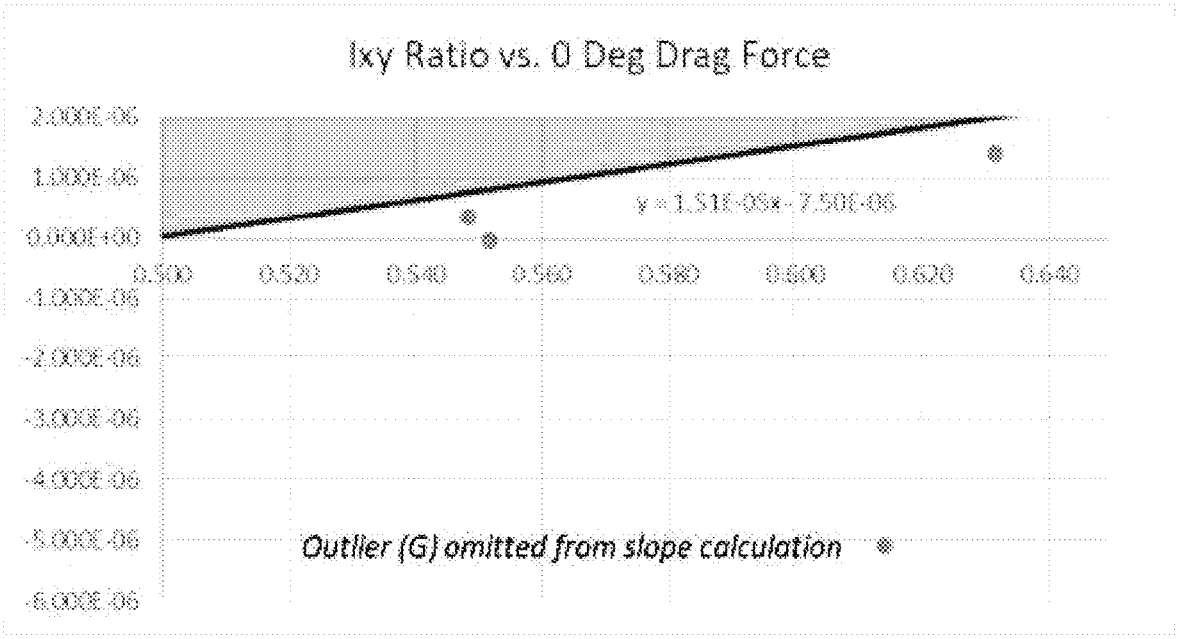
FIG. 16 illustrates a relationship between the Ixy ratio and the drag force for various known golf club heads.

In many known golf club heads, shifting the CG position farther back to increase launch angle of a golf ball and/or to increase club head moment of inertia, can adversely affect other performance characteristics of the club head, such as aerodynamic drag and products of inertia. FIG. 16 illustrates that for many known club heads having a volume and/or loft angle similar to club head, as the club head CG depth 172 increases (to increase club head forgiveness and or launch angle), the force of drag during a swing increases (thereby reducing swing speed and ball distance). For many known club heads, as the head CG depth increases, the force of drag on the club head increases and the Ixy decreases.

The club head 100 described herein balances the club head CG depth 172 and Ixy product of inertia compared to known club heads having similar volume and/or loft angle, while simultaneously maintaining or reducing aerodynamic drag. Accordingly, the club head 100 has improved impact performance characteristics (e.g. spin, launch angle, ball speed, and forgiveness) also balances or improves swing performance characteristics (e.g. aerodynamic drag, ability to square the club head at impact, and swing speed).

In many embodiments, the club head 100 satisfies the following relation, such that the head Ixy product of inertia ratio is increased, while maintaining or reducing the drag force ($F_d$) on the club head 100, compared to known golf club heads.

$$\frac{I_{xy}\text{Ratio} + (7.50 \times 10^{-6})}{(1.51 \times 10^{-5}) \times (F_d)} > 1 \quad \text{(iii)}$$

d. Balance of Product of Inertia (Ixz Ratio), Drag, and CG

Figure 18:
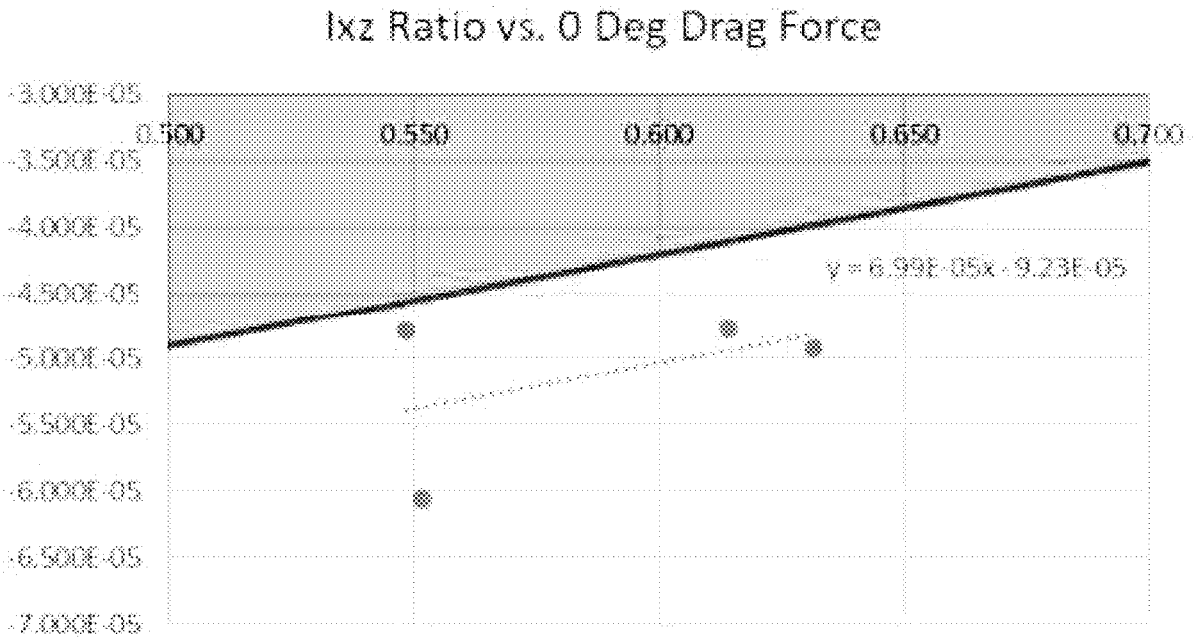
FIG. 18 illustrates a relationship between the Ixz ratio and the drag force for various known golf club heads.

In many known golf club heads, shifting the CG position farther back to increase launch angle of a golf ball and/or to increase club head inertia, can adversely affect other performance characteristics of the club head, such as aerodynamic drag and products of inertia. FIG. 18 illustrates that for many known club heads having a volume and/or loft angle similar to club head, as the club head CG depth increases (to increase club head forgiveness and or launch angle), the force of drag during a swing increases (thereby reducing swing speed and ball distance). For many known club heads, as the head CG depth increases, the force of drag on the club head increases and the Ixz decreases (becomes more negative in magnitude).

The club head described herein increases or maximizes the club head CG depth and Ixz product of inertia compared to known club heads having similar volume and/or loft angle, while simultaneously maintaining or reducing aerodynamic drag. Accordingly, the club head having improved impact performance characteristics (e.g. spin, launch angle, ball speed, and forgiveness) also balances or improves swing performance characteristics (e.g. aerodynamic drag, ability to square the club head at impact, and swing speed).

In many embodiments, the club head satisfies the following relation, such that the head Ixz product of inertia ratio is balanced, while maintaining or reducing the drag force ($F_d$) on the club head, compared to known golf club heads.

$$\frac{I_{xz}\text{Ratio} - (9.23 \times 10^{-5})}{(6.99 \times 10^{-5}) \cdot (F_d)} > 1 \quad \text{(iv)}$$

VI. Example Club Head Balancing Product of Inertia, CG Position, Moment of Inertia, and Aerodynamic Drag Described herein is an exemplary golf club head having similar dimensions (length, width, height, depth, CG height, CG depth) as golf club head 100, and similar weight positions as club head 300. The exemplary golf club head comprises a volume of 466 cc, a depth of 4.81 inches, a length of 5.10 inches, and a height of 2.57 inches. The exemplary club head includes a plurality of thin regions (similar to that of golf club head 100) on the crown comprising 57% of the surface area of the crown and having a minimum thickness of 0.013 inch. The exemplary club head further includes a crown angle (similar to that of golf club head 100) of 68.6 degrees and a crown angle height of 0.522 inch.

The exemplary club head includes two embedded weights comprising tungsten having a specific gravity of 14 SG and masses of 16.6 grams and 22.8 grams. One embedded weight is located near the toe and crown (similar to that of club head 300), at least partially bounded between the 11 o'clock ray and 9 o'clock ray of the clock grid, as well as intersecting the 10 o'clock ray (wherein the clock grid is identical to that of club head 100). Further, the second embedded weight is located near the heel and the sole, at least partially bounded between the 3 o'clock ray and 5 o'clock ray of the clock grid, as well as intersecting the 4 o'clock ray. In this example, the club head is structured to form an inertia tensor matrix as follows:

$$I_{Exemplary} = \begin{bmatrix} 2{,}684\ \text{g-cm}^2 & 164\ \text{g-cm}^2 & -154\ \text{g-cm}^2 \\ 164\ \text{g-cm}^2 & 4{,}968\ \text{g-cm}^2 & -345\ \text{g-cm}^2 \\ -154\ \text{g-cm}^2 & -345\ \text{g-cm}^2 & 3{,}477\ \text{g-cm}^2 \end{bmatrix}$$

As a result of the above described and/or additional parameters, the exemplary club head comprises a head CG depth of 1.36 inches and a head CG height of 0.14 inches. Further, as a result of the above described and/or additional parameters, the exemplary club head comprises a crown-to-sole moment of inertia $I_{xx}$ of 2,684 g·cm$^2$, a heel-to-toe moment of inertia $I_{yy}$ of 4,684 g·cm$^2$, an Ixy product of inertia of 164 g·cm$^2$, an Ixz product of inertia of −154 g·cm$^2$, and a combined moment of inertia $I_{xx}+I_{yy}$ of 7,368 g·cm$^2$.

The exemplary club head further includes a front radius of curvature (similar to golf club head 100) of 0.24 inch, a sole radius of curvature of 0.30 inch, and a rear radius of curvature of 0.20 inch. As a result of the these and/or additional parameters, the exemplary club head comprises an aerodynamic drag force of 0.95 lbf when simulated using computational fluid dynamics with a squared face at an air speed of 102 miles per hour (mph).

The exemplary club head was compared to a control golf club (hereafter "Control Club") of similar height, length, and volume. However, the Control Club only had one weight on the rear external periphery of the club head. Further, the Control Club comprised an inertia tensor matrix as follows:

$$I_{Control} = \begin{bmatrix} 3{,}703\ \text{g-cm}^2 & 3.23\ \text{g-cm}^2 & -572\ \text{g-cm}^2 \\ 3.23\ \text{g-cm}^2 & 5{,}329\ \text{g-cm}^2 & -500\ \text{g-cm}^2 \\ -572\ \text{g-cm}^2 & -500\ \text{g-cm}^2 & 2{,}935\ \text{g-cm}^2 \end{bmatrix}$$

The exemplary club head has a 27.5% reduction in Ixx, and a 6% decrease in Iyy, in comparison to the Control Club. The exemplary club head has a 27% decrease in CG depth, and a 68% in CG height, in comparison to the Control Club. However, the exemplary club head has an 18.4% increase in Izz, a 4,977% increase in Ixy, and a 73% increase in Ixz, over the Control Club.

Figure 23:
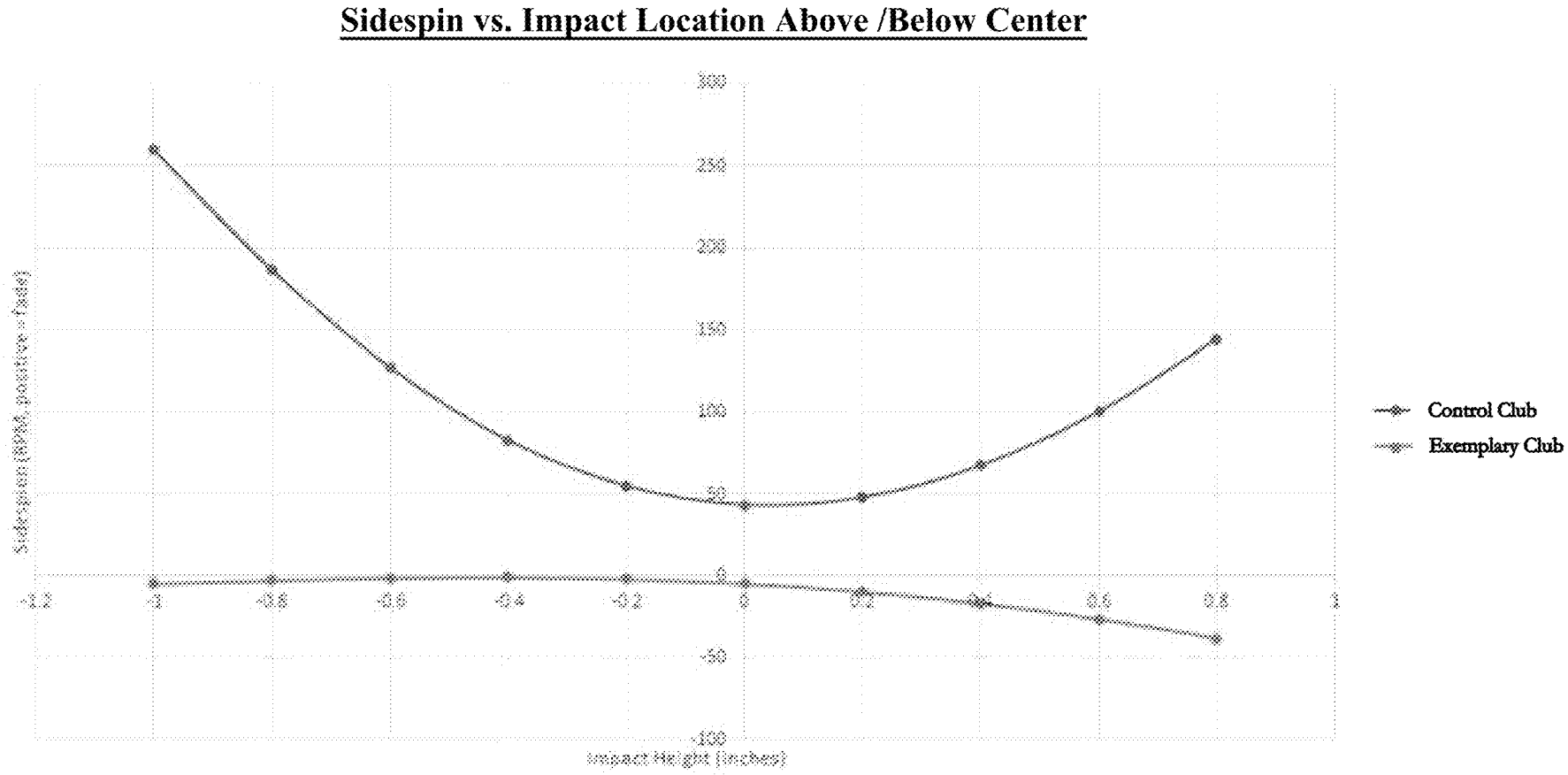
FIG. 23 illustrates an actual relationship between the sidespin imparted on a golf ball and the impact location above or below the geometric center of the golf club head of FIG. 19.

In reference to FIG. 23, the sidespin incurred by high and low face hits is displayed for the Control Club and the exemplary club. The horizontal axis of FIG. 23 displays the Impact Height on the strikeface, wherein the origin is the geometric center, a negative value is below center, and a positive value is above center. The vertical axis of FIG. 23 displays the sidespin (in revolutions per minute) imparted on the golf ball at impact, wherein positive value is fade spin, and a negative value is draw spin.

Referring to FIG. 23, the exemplary club nearly eliminated all unwanted sidespin, when the golf ball was struck between 0.1 inch-1 inch below center. In particular, when the golf ball is struck 0.6 inches below the geometric center, the exemplary club head reduces the sidespin by approximately 125 RPM, over the Control Club. When the golf ball is struck 0.4 inches below center, the exemplary club reduces the sidespin by approximately 75 RPM.

Still referring to FIG. 23, when the golf ball is stuck above center, the unwanted sidespin drastically equally reduced. However, the large fade spin (approximately 50 RPM—approximately 150 RPM) of the Control Club, is transitioned into a very small draw spin (approximately 0 RPM—approximately 45 RPM). It can be concluded that although the exemplary club head has a reduced Ixx and Iyy, in comparison to the Control Club, the exemplary club head reduces, or even eliminates, unwanted sidespin when a golf ball is struck above or below center. This reduction (or elimination) of sidespin, of the exemplary club head, provides greater forgiveness than the high Ixx term of the Control Club, since the ball will travel on a much straighter path, rather than spinning offline.

Further still, the exemplary club head only has a 6.8% reduction in the Iyy term, thereby still maintaining an optimal forgiveness when the golf ball is struck towards the toe or towards the heel. The Iyy moment of inertia is often maximized as much as possible, as evidenced by the Control Club. However, a small reduction in the Iyy, and a drastic increase to the Ixz term and Ixy term, leads to the exemplary club head having increased forgiveness in all four directions (towards the toe, heel, crown, and sole) away from the geometric center not just towards the heel and toe as does the Control Club.

The exemplary club head balances the increased forgiveness (achieved through balanced MOI and products of inertia), with a deep and low CG, that allows for desirable launch conditions. A high launching, low spinning ball flight is desired with driver type club heads, in order to hit high, far traveling golf shots. When the CG height and CG depth of the exemplary club head, are paired with the inertia tensor (achieved through the embedded weights, similar to that of golf club head 300), a high-launching, low spinning, and straighter (increased forgiveness to do the balance of products of inertia with MOI) driver is formed.

Finally, it is noted that the exemplary club, balances the inertia tensor, CG parameters, all while maintaining steep front radius of curvature, sole radius of curvature, and rear radius of curvature. As a result of the these and/or additional parameters, the exemplary club head comprises an aerodynamic drag force of 0.95 lbf, which is equal to that of the Control Club Head. However, as aforementioned the exemplary club head has a more preferable balance of increased forgiveness, with maintained swing speed (due to the low drag force), and desirable performance characteristics (high launch and low spin, due to the CG height and CG depth).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club (i.e., driver, fairway wood) the apparatus, methods, and articles of manufacture described herein may be applicable to other types of golf club such as a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A hollow body golf club head comprising:

a body having a front end, a back end opposite the front end, a crown, a sole opposite the crown, a heel, a toe opposite the heel, a skirt adjoining the crown and the sole, and a hosel structure having a hosel axis extending centrally through a bore in the hosel structure;

a strikeface positioned at the front end and defining a geometric center, a loft plane tangent to the geometric center, and a head depth plane extending through the geometric center from the heel to the toe, perpendicular to the loft plane;

wherein:

a loft angle of the club head is less than 16 degrees;

a volume of the club head is greater than 400 cc;

a head center of gravity of the club head is located at a head CG depth from the loft plane, measured in a direction perpendicular to the loft plane, and a head CG height from a head depth plane, measured in a direction perpendicular to the head depth plane;

the head CG height is less than 0.20 inches;

a y-axis extending through the head center of gravity from the crown to the sole;

an x-axis extending through the head center of gravity from the heel to the toe, wherein the x-axis is perpendicular to the y-axis;

the club head experiences a drag force $F_d$ when subjected to an air speed of 102 mph in a direction perpendicular to a plane extending through the geometric center of the strikeface, parallel to the hosel axis, and positioned at the loft angle from the loft plane;

the club head has a crown to sole moment of inertia Iyy, and a heel to toe moment of inertia Ixx, and a product of inertia Ixy about the x-axis and y-axis;

wherein the product of inertia is at greater than 100 g·cm$^2$;

the club head satisfies relation A and relation B:

$$\frac{Ixy}{Ixx \cdot Iyy} > 4.45 \times 10^{-5} \quad \text{A.}$$

$$F_d < 1.15 \text{ lbf.} \quad \text{B.}$$

2. The golf club head of claim 1, wherein the club head further satisfies relation C:

$$\frac{A + (4.75 \times 10^{-7})}{(3.24 \cdot 10^{-5}) \cdot (CG_{height})} > 1. \quad \text{C.}$$

3. The golf club head of claim 1, wherein the club head further satisfies relation D:

$$\frac{A + (7.50 \times 10^{-6})}{(1.51 \times 10^{-5}) \cdot (F_d)} > 1. \quad \text{D.}$$

4. The golf club head of claim 1, wherein the head CG depth is greater than 1.3 inches.

5. The golf club head of claim 1, further comprises:

a 12 o'clock ray;

a 3 o'clock ray;

a 4 o'clock ray;

a 5 o'clock ray;

a 8 o'clock ray;

a 9 o'clock ray;

a 10 o'clock ray; and an 11 o'clock ray;

when the golf club head is at an address portion, from a bottom view of the golf club head, the 12 o'clock ray is aligned with the strikeface geometric center and orthogonal to a front intersection line between the loft plane and a ground plane;

a clock grid is centered along the 12 o'clock ray, at a midpoint between the front end of the head and the rear end of the head;

the 3 o'clock ray extends towards the heel;

the 9 o'clock ray extends towards the toe;

a first embedded weight and a second embedded weight;

wherein the first embedded weight can be located near the toe and crown, at least partially bounded between the 11 o'clock ray and 9 o'clock ray of the clock grid, as well as intersecting the 10 o'clock ray; and wherein the second embedded weight can be located near the heel and the sole, at least partially bounded between the 3 o'clock ray and 5 o'clock ray of the clock grid, as well as intersecting the 4 o'clock ray.

6. The golf club head of claim 5, wherein;

the first and second embedded weights comprise tungsten.

7. The golf club head of claim 1, wherein the Iyy moment of inertia is greater than 4500 g·cm$^2$.

8. The golf club head of claim 1, wherein a combined moment of inertia is greater than 7250 g·cm$^2$.

9. The golf club head of claim 1, further comprising:

a front radius of curvature between 0.18 to 0.30 inch, wherein the front radius of curvature extends from a top edge of the strikeface to a crown transition point, the crown transition point indicating a change in curvature from the front radius of curvature to a different curvature of the crown; and a rear radius of curvature that extends between the crown and the skirt of the club head along a rear transition boundary from a first rear transition point located at a junction between the crown and the rear transition boundary and a second rear transition point located at the junction between the rear transition boundary and the skirt of the club head.

10. The golf club head of claim 9, further comprising:

a crown angle less than 79 degrees, wherein the crown angle is measured as an acute angle between a front plane and a crown axis that extends through the crown transition point and a rear transition point of the club head; and a maximum crown height greater than 0.50 inch, wherein the maximum crown height is measured as a greatest distance between a surface of the crown and the crown axis.

11. A hollow body golf club head comprising:

a body having a front end, a back end opposite the front end, a crown, a sole opposite the crown, a heel, a toe opposite the heel, a skirt adjoining the crown and the sole, and a hosel structure having a hosel axis extending centrally through a bore in the hosel structure;

a strikeface positioned at the front end and defining a geometric center, a loft plane tangent to the geometric center, and a head depth plane extending through the geometric center from the heel to the toe, perpendicular to the loft plane;

wherein:

a loft angle of the club head is less than 16 degrees;

a volume of the club head is greater than 400 cc;

a head center of gravity of the club head is located at a head CG depth from the loft plane, measured in a direction perpendicular to the loft plane, and at a head CG height from a head depth plane, measured in a direction perpendicular to the head depth plane;

the head CG height is less than 0.20 inches;

a y-axis extending through the head center of gravity from the crown to the sole;

an x-axis extending through the head center of gravity from the heel to the toe, wherein the x-axis is perpendicular to the y-axis;

the club head experiences a drag force Fd when subjected to an air speed of 102 mph in a direction perpendicular to a plane extending through the geometric center of the strikeface, parallel to the hosel axis, and positioned at the loft angle from the loft plane;

the club head has a crown to sole moment of inertia Iyy, and a heel to toe moment of inertia Ixx, and a product of inertia Ixy about the x-axis and y-axis;

wherein the product of inertia is at greater than 100 g·cm2;

the club head has a strike face to skirt moment of inertia Izz, and a heel to toe moment of inertia Ixx, and a product of inertia Ixz about a z-axis and about the x-axis;

the club head satisfies relation A:

$$\frac{Ixz}{Ixx \cdot Izz} > -1.36 \times 10^{-5}. \quad \text{A.}$$

12. The golf club head of claim 11, wherein the club head further satisfies relation D:

$$\frac{A - (1.12 \times 10^{-4})}{(9.01 \cdot 10^{-5}) \cdot (CG_{depth})} > 1. \quad \text{B.}$$

13. The golf club head of claim 11, wherein the club head further satisfies relation C:

$$\frac{A - (9.23 \times 10^{-5})}{(6.99 \times 10^{-5}) \cdot (F_d)} > 1. \quad \text{C.}$$

14. The golf club head of claim 11, wherein the club head further satisfies relation D:

$$F_d < 1.15 \text{ lb.} \quad \text{D.}$$

15. The golf club head of claim 11, wherein the head CG depth is greater than 1.3 inches.

16. The golf club head of claim 11, further comprises:

a 12 o'clock ray;

a 3 o'clock ray;

a 4 o'clock ray;

a 5 o'clock ray;

a 8 o'clock ray;

a 9 o'clock ray;

a 10 o'clock ray; and an 11 o'clock ray;

when the golf club head is at an address portion, from a bottom view of the golf club head, the 12 o'clock ray is aligned with the strikeface geometric center and orthogonal to a front intersection line between the loft plane and a ground plane;

a clock grid is centered along the 12 o'clock ray, at a midpoint between the front end of the head and the rear end of the head;

the 3 o'clock ray extends towards the heel; and the 9 o'clock ray extends towards the toe;

a first embedded weight and a second embedded weight;

wherein the first embedded weight can be located near the toe and crown, at least partially bounded between the 11 o'clock ray and 9 o'clock ray of the clock grid, as well as intersecting the 10 o'clock ray; and wherein the second embedded weight can be located near the heel and the sole, at least partially bounded between the 3 o'clock ray and 5 o'clock ray of the clock grid, as well as intersecting the 4 o'clock ray.

17. The golf club head of claim 16, wherein;

the first and second embedded weights comprise tungsten.

18. The golf club head of claim 11, wherein a combined moment of inertia is greater than 7250 $g \cdot cm^2$.

19. The golf club head of claim 11, further comprising:

wherein the Ixz is greater −160 $g \cdot cm^2$.

20. The golf club head of claim 11, wherein the Iyy moment of inertia is greater than 4500 $g \cdot cm^2$.

* * * * *